US009465330B2

(12) United States Patent
Morimoto

(10) Patent No.: US 9,465,330 B2
(45) Date of Patent: Oct. 11, 2016

(54) IMAGE FORMING APPARATUS HAVING CLEANING DEVICE FOR INTERMEDIATE TRANSFER MEMBER

(71) Applicant: KYOCERA Document Solutions Inc., Osaka-shi, Osaka (JP)

(72) Inventor: Kanako Morimoto, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/989,821

(22) Filed: Jan. 7, 2016

(65) Prior Publication Data

US 2016/0202642 A1 Jul. 14, 2016

(30) Foreign Application Priority Data

Jan. 9, 2015 (JP) ..... 2015-003299
Jan. 9, 2015 (JP) ..... 2015-003300

(51) Int. Cl.
*G03G 15/16* (2006.01)

(52) U.S. Cl.
CPC ..... *G03G 15/1665* (2013.01); *G03G 15/161* (2013.01); *G03G 15/1675* (2013.01)

(58) Field of Classification Search
CPC ..... G03G 15/1665; G03G 15/1675; G03G 15/168; G03G 15/161
USPC ..... 399/66, 101, 301
See application file for complete search history.

(56) References Cited

U.S. PATENT DOCUMENTS 7,865,108 B2 * 1/2011 Shibuya et al. ..... G03G 15/161 399/101
7,877,032 B2 * 1/2011 Takeuchi ..... G03G 15/161 399/101
8,731,431 B2 * 5/2014 Sugiura et al. ..... G03G 15/161 399/101
2008/0292330 A1 11/2008 Kabashima et al.

FOREIGN PATENT DOCUMENTS

JP 2008292727 A 12/2008

* cited by examiner

*Primary Examiner* — William J Royer

(57) ABSTRACT

To remove toner, which is primarily transferred onto an intermediate transfer member, from the intermediate transfer member, a digital multifunction peripheral includes a first control unit that controls a second bias applicator to apply to a secondary transfer roller a bias of the opposite polarity to the charged toner when the toner passes through a position where the secondary transfer roller is placed, and a second control unit that, after the operation of the first control unit, controls a second bias applicator to apply to the secondary transfer roller a bias of the same polarity as the charged toner and controls a pre-brush bias applicator to apply to a pre-brush a bias of the opposite polarity to the toner.

10 Claims, 11 Drawing Sheets

IMAGE FORMING APPARATUS HAVING CLEANING DEVICE FOR INTERMEDIATE TRANSFER MEMBER

INCORPORATION BY REFERENCE

The disclosures of Japanese Patent Applications No. 2015-3299 and No. 2015-3300 filed on Jan. 9, 2015 each including the specification, drawings and abstract are incorporated herein by reference in their entirety.

BACKGROUND

The present disclosure relates to an image forming apparatus.

Image forming apparatuses, typified by digital multifunction peripherals, read an image of an original document by using an image reading unit, and then emit light to a photoreceptor in an image forming unit based on the read image to form an electrostatic latent image on the photoreceptor. Then, a charged developer, including toner and other components, is applied onto the formed electrostatic latent image to make it into a visible image that is in turn transferred onto a sheet of paper and fixed. The sheet with the image fixed thereon is discharged outside the image forming apparatus.

Some of the image forming apparatuses have a full-color printing capability and they form full-color images by superimposing different colors, e.g. yellow, cyan, magenta, and black. The formation of full-color images involves forming images of the different colors on photoreceptors provided for each of the colors, and primarily transferring the different color images onto an intermediate transfer member in the image forming apparatuses. In other words, the different color images are overlaid with one another on the intermediate transfer member to form a full-color image. The full-color image formed on the intermediate transfer member is secondarily transferred onto a sheet of paper.

Such a system, which performs the primary transfer process for temporarily transferring formed images onto the intermediate transfer member and the secondary transfer process for subsequently transferring the images onto a sheet of paper, encounters the following situation. Sometimes, an image forming apparatus forms a toner image, which will not be transferred onto paper, on the intermediate transfer member at predetermined timings for the purpose of adjusting the quality and other factors of images to be formed. The toner image formed for the purpose is never transferred onto paper. After the image quality adjustment, the toner remaining on the intermediate transfer member is removed by a cleaning blade. When a paper jam occurs after formation of a full-color toner image on the intermediate transfer member and the apparatus stops its operation, the full-color toner image is also removed as with the case above.

There are some well-known conventional techniques for removing toner remaining on the intermediate transfer member. A typical image forming apparatus includes a primary transfer device for transferring a toner image, which is visualized by developing an electrostatic latent image formed on an image carrier, onto an intermediate transfer member, a secondary transfer device provided with a secondary transfer roller for transferring the toner image on the intermediate transfer member onto a recording medium and a secondary transfer opposed roller disposed at an opposite position to the secondary transfer roller with respect to the intermediate transfer member, a secondary transfer bias applying device for applying a bias to the secondary transfer roller or the secondary transfer opposed roller to transfer the toner image onto the recording medium, a transfer roller cleaning device to clean toner on the secondary transfer roller, a bending roller being in contact with an outer surface of the intermediate transfer member, and an intermediate transfer member cleaning device disposed between the secondary transfer device and the bending roller to clean toner on the intermediate transfer member. The image forming apparatus includes a control device that controls the secondary transfer bias applying device so as to apply a bias having the same polarity in a recovery sequence executed after detecting a jam of the recording medium on the way of conveyance of the recording medium or after detecting a shortage of the recording medium in a sheet feeding tray for storing the recording medium on the way of successive image forming.

SUMMARY

In one aspect of the present disclosure, an image forming apparatus includes a photoreceptor, a developing unit, an intermediate transfer member, a primary transfer roller, a first bias applicator, a secondary transfer roller, a second bias applicator, a pre-brush, a pre-brush bias applicator, a cleaning blade, a first control unit, and a second control unit. The developing unit forms a toner image on the photoreceptor. The intermediate transfer member rotates in only one direction and has a surface onto which the toner image formed on the photoreceptor is primarily transferred. The primary transfer roller primarily transfers the toner image formed on the photoreceptor onto the intermediate transfer member with application of a bias. The first bias applicator applies a bias to the primary transfer roller. The secondary transfer roller secondarily transfers the toner image, which is primarily transferred on the intermediate transfer member, onto a recording medium with application of a bias. The second bias applicator applies a bias to the secondary transfer roller. The pre-brush is placed downstream of the secondary transfer roller along the rotational direction of the intermediate transfer member, and abuts against the surface of the intermediate transfer member. The pre-brush bias applicator applies a bias to the pre-brush. The cleaning blade is placed downstream of the pre-brush along the rotational direction of the intermediate transfer member, and abuts against the surface of the intermediate transfer member to remove toner remaining on the intermediate transfer member. To remove the toner, which is primarily transferred onto the intermediate transfer member, from the intermediate transfer member, the first control unit controls the second bias applicator to apply to the secondary transfer roller a bias of the opposite polarity to that of a charge of the toner when the toner passes through a position where the secondary transfer roller is placed. After the operation of the first control unit, the second control unit controls the second bias applicator to apply to the secondary transfer roller a bias of the same polarity as that of the charge of the toner and controls the pre-brush bias applicator to apply to the pre-brush a bias of the opposite polarity to that of the toner.

In another aspect of the present disclosure, an image forming apparatus includes a photoreceptor, a developing unit, an intermediate transfer member, a primary transfer roller, a first bias applicator, a secondary transfer roller, a second bias applicator, a pre-brush, a pre-brush bias applicator, a cleaning brush, a collecting roller, a collecting-roller bias applicator, a cleaning blade, the first control unit, and the second control unit. The developing unit forms a toner image on the photoreceptor. The intermediate transfer member rotates in only one direction and has a surface onto which the toner image formed on the photoreceptor is primarily transferred. The primary transfer roller primarily transfers the toner image formed on the photoreceptor onto the intermediate transfer member with application of a bias. The first bias applicator applies a bias to the primary transfer roller. The secondary transfer roller secondarily transfers the toner image, which is primarily transferred on the intermediate transfer member, onto a recording medium with application of a bias. The second bias applicator applies a bias to the secondary transfer roller. The pre-brush is placed downstream of the secondary transfer roller along the rotational direction of the intermediate transfer member, and abuts against the surface of the intermediate transfer member. The pre-brush bias applicator applies a bias to the pre-brush. The cleaning brush is placed downstream of the pre-brush along the rotational direction of the intermediate transfer member, and abuts against the surface of the intermediate transfer member to remove toner remaining on the intermediate transfer member. The collecting roller is placed so as to abut against the cleaning brush and collects toner clinging to the cleaning brush. The collecting-roller bias applicator applies a bias to the collecting roller. The cleaning blade abuts against a surface of the collecting roller and removes toner clinging to the collecting roller. To remove the toner, which is primarily transferred onto the intermediate transfer member, from the intermediate transfer member, the first control unit controls the second bias applicator to apply to the secondary transfer roller a bias of the opposite polarity to that of a charge of the toner and controls the pre-brush bias applicator to apply to a pre-brush a bias having the same polarity as that of the toner and an absolute value smaller than the bias applied by the second bias applicator, when the toner passes through a position where the secondary transfer roller is placed. After the operation of the first control unit, the second control unit controls the second bias applicator to apply to the secondary transfer roller a bias of the same polarity as that of the charge of the toner.

DETAILED DESCRIPTION

Figure 1:
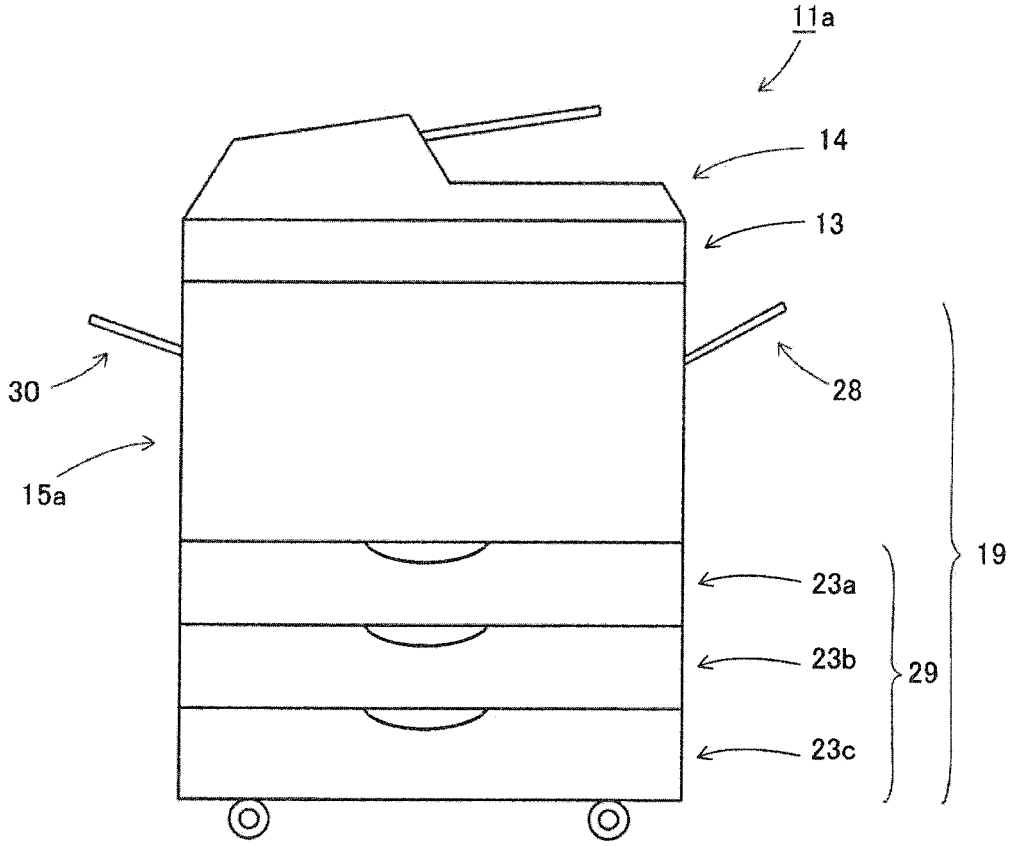
FIG. 1 is a schematic external view of a digital multifunction peripheral to which an image forming apparatus according to an embodiment of the present disclosure is applied.
Figure 2:
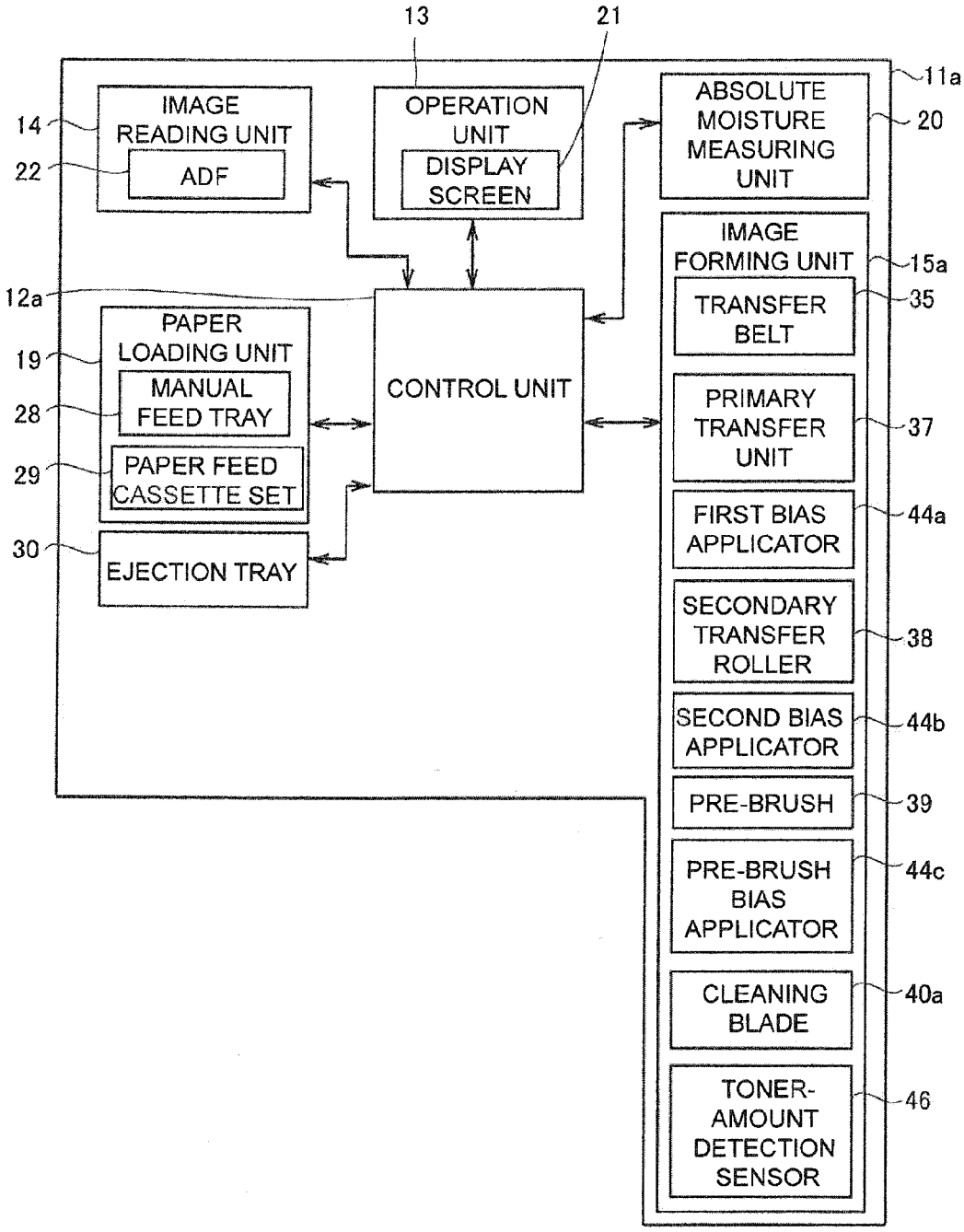
FIG. 2 is a block diagram showing the configuration of the digital multifunction peripheral to which the image forming apparatus according to the embodiment of the disclosure is applied.

Embodiments of the present disclosure will be described below. FIG. 1 is a schematic external view of a digital multifunction peripheral 11*a* to which an image forming apparatus according to an embodiment of the disclosure is applied. FIG. 2 is a block diagram showing the configuration of the digital multifunction peripheral 11*a* to which the image forming apparatus according to the embodiment of the disclosure is applied.

Referring to FIGS. 1 and 2, the digital multifunction peripheral 11*a* includes a control unit 12*a*, an operation unit 13, an image reading unit 14, a paper loading unit 19, and an image forming unit 15*a*. The control unit 12*a* serves as first and second control units to control the entire digital multifunction peripheral 11*a*. The operation unit 13 includes a display screen 21 that displays information submitted from the digital multifunction peripheral 11*a* and entries made by users. The operation unit 13 allows the users to input image forming conditions, such as the number of copies and gradation degrees, and to turn on or off the power source. The image reading unit 14 includes an auto document feeder (ADF) 22 that automatically conveys an original document loaded thereon to the image reading unit 14. The image reading unit 14 reads images of the original document. The paper loading unit 19 includes a manual feed tray 28 on which paper is manually loaded, and a paper feed cassette set 29 including paper feed cassettes 23*a*, 23*b*, 23*c* each accommodating multiple sheets of paper. The paper loading unit 19 accommodates sheets of paper on which images are to be formed. The image forming unit 15*a* forms images based on read image data or image data transmitted from computers or other types of devices. Arrows in FIG. 2 indicate control signal flows and data flows relating to control operations and images.

The digital multifunction peripheral 11*a* operates as a copier by causing the image forming unit 15*a* to form an image from an original document read by the image reading unit 14. In addition, the digital multifunction peripheral 11*a* operates as a printer by causing the image forming unit 15*a* to form an image using image data transmitted from computers or other types of devices, and to print it on paper. In other words, the image forming unit 15*a* operates as a printing unit for printing required images. The digital multifunction peripheral 11*a* has a plurality of functions relating to image processing, such as a copying function, a printer function, and a facsimile function.

Figure 3:
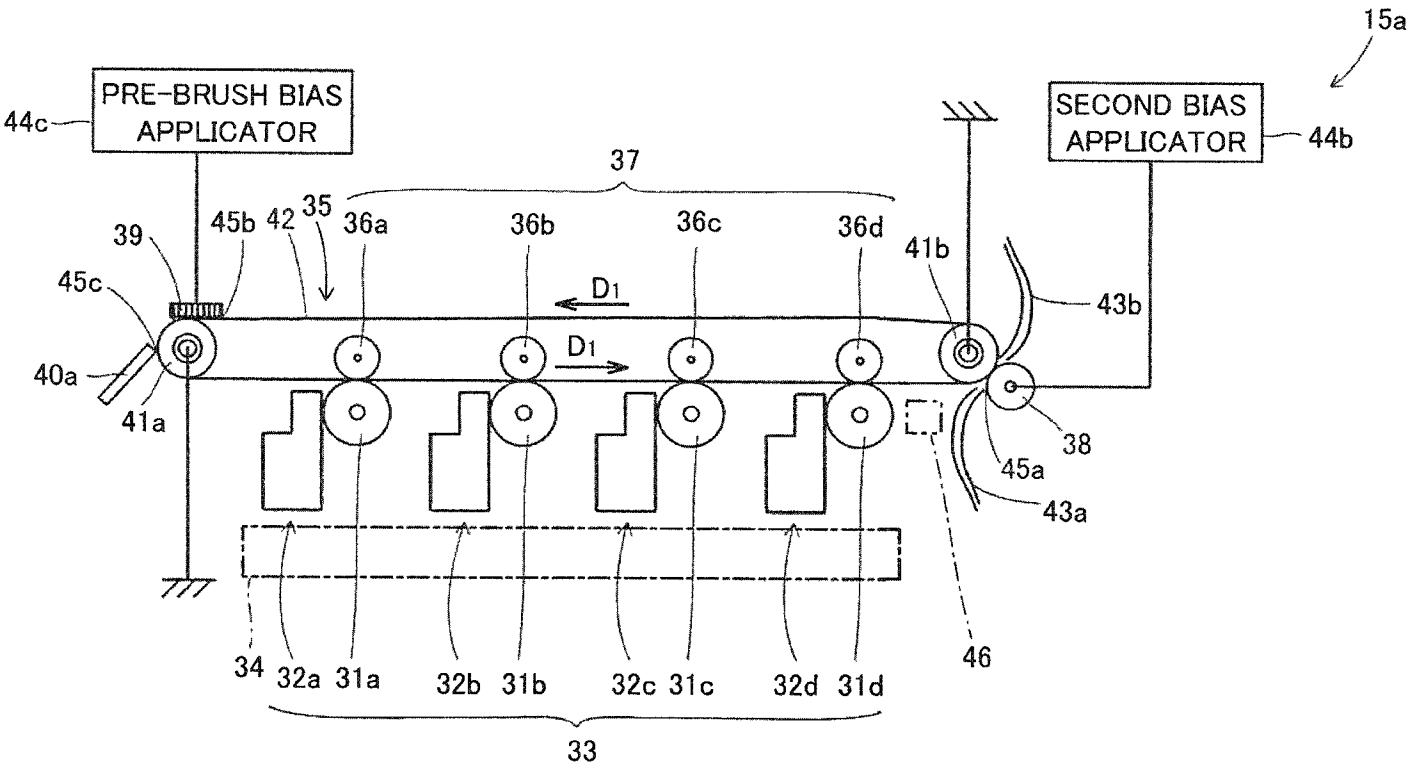
FIG. 3 is a schematic cross-sectional view showing a simple configuration of an image forming unit provided in the digital multifunction peripheral.

A more detailed description will be made about the image forming unit 15*a* in the digital multifunction peripheral 11*a*. FIG. 3 is a schematic cross-sectional view showing a simple configuration of the image forming unit 15*a* in the digital multifunction peripheral 11*a*. In order to provide a clear understanding, hatch patterns are removed from the components in FIG. 3. The cross-sectional view in FIG. 3 is taken along a vertical plane of the digital multifunction peripheral 11*a*.

Referring to FIG. 3, the image forming unit 15*a* includes a developing device 33, a laser scanner unit (LSU) 34, a transfer belt 35 serving as an intermediate transfer member, a primary transfer unit 37 including four primary transfer rollers 36*a*, 36*b*, 36*c*, 36*d*, a first bias applicator 44*a* for applying a bias to each of the four primary transfer rollers 36*a*, 36*b*, 36*c*, 36*d*, a secondary transfer roller 38, a second bias applicator 44*b* for applying a bias to the secondary transfer roller 38, a pre-brush 39, a pre-brush bias applicator 44*c* for applying a bias to the pre-brush 39, a cleaning blade 40*a*, and a toner-amount detection sensor 46. The LSU 34 is schematically shown by a dot-and-dash line. The toner-amount detection sensor 46 is schematically shown by a dashed double-dotted line. The image forming unit 15*a* employed by the digital multifunction peripheral 11*a* is a so-called tandem process system using four colors.

The developing device 33 includes four photoreceptors 31*a*, 31*b*, 31*c*, 31*d* associated with four colors, yellow, magenta, cyan, and black, respectively, and four developing units 32*a*, 32*b*, 32*c*, 32*d*. FIG. 3 depicts the developing units 32*a* to 32*d* in a schematic manner.

The LSU 34 exposes the four photoreceptors 31*a* to 31*d* with light based on an image read by the image reading unit 14. An electrostatic latent image is formed on each of the light photoreceptors 31*a* to 31*d* based on the respective color components of the exposure light. The developing units 32*a* to 32*d* supply toner of different colors to the electrostatic latent images formed on the photoreceptors 31*a* to 31*d*, respectively. The toner is agitated in the developing units 32*a* to 32*d* to be charged, for example, positively. The charged toner is supplied onto the photoreceptors 31*a* to 31*d* to form toner images on the photoreceptors 31*a* to 31*d*. The toner images formed on the photoreceptors 31*a* to 31*d* are primarily transferred onto the transfer belt 35.

The transfer belt 35 has no end. The transfer belt 35 is rotated unidirectionally by a driving roller 41*a* and a driven roller 41*b*. The rotational direction of the transfer belt 35 is indicated by an arrow D1 in FIG. 3. The transfer belt 35 rotates from the left to the right as viewed from its lower side where the photoreceptors 31*a* to 31*d* are disposed, but rotates from the right to the left as viewed from its upper side where the pre-brush 39 is disposed. Of the developing units 32*a* to 32*d*, the yellow developing unit 32*a* is disposed on the most upstream side along the rotational direction of the transfer belt 35, while the black developing unit 32*d* is disposed on the most downstream side. The transfer belt 35 rotates from the upstream side to the downstream side.

The transfer belt 35 is a general layered-type thin elastic belt. Specifically, the transfer belt 35 is made of mainly an elastic rubber belt of about 200 μm (micrometers) thickness, with a front side coated with resin of about 2 to 3 μm thickness and a back side coated with resin of about 100 μm thickness.

The four primary transfer rollers 36*a* to 36*d* are placed opposite to the photoreceptors 31*a* to 31*d*, respectively, with respect to the transfer belt 35. The primary transfer unit 37 primarily transfers toner images of four different colors, yellow, magenta, cyan, and black, which are formed by the developing units 32*a* to 32*d*, onto the transfer belt 35. Specifically, the first bias applicator 44*a* applies a bias to each of the primary transfer rollers 36*a* to 36*d* to primarily transfer the toner images, which are formed on the photoreceptors 31*a* to 31*d* by the developing units 32*a* to 32*d*, onto a surface 42 of the transfer belt 35. During the primary transfer, the images of different colors are superimposed on the transfer belt 35 to form a full-color image on the transfer belt 35.

The secondary transfer roller 38 and the driven roller 41*b* are placed opposite to each other with respect to the transfer belt 35. A specific example of the secondary transfer roller 38 is a foam rubber roller with electrical conductivity.

The image forming unit 15*a* includes a paper transport path 43*a* extending to a position 45*a* where the secondary transfer roller 38 abuts against the surface 42 of the transfer belt 35. Paper, or a recording medium, is carried through the paper transport path 43*a*. The image forming unit 15*a* also includes a paper transport path 43*b* through which paper that has received an image in a secondary transfer process is carried toward a fuser unit (not shown). The paper is supplied to the position 45*a* where the secondary transfer roller 38 abuts against the surface 42 of the transfer belt 35 through the paper transport path 43*a* positioned on the upstream side where the paper feed cassette set 29 is provided. In synchronization with the time at which the paper is carried to the position 45*a*, the second bias applicator 44*b* applies to the secondary transfer roller 38 a bias of the opposite polarity to the toner. With the application of the bias to the secondary transfer roller 38, the toner image formed on the surface 42 of the transfer belt 35 is electrically attracted toward the paper supplied, thereby being secondarily transferred onto the paper. The paper on which the toner image has been transferred is carried through the paper transport path 43*b* to the fuser unit (not shown).

The pre-brush 39 is placed downstream of the secondary transfer roller 38 and is also placed opposite to the driving roller 41*a* with respect to the transfer belt 35. The pre-brush 39 is in the shape of a typical brush and has an end portion abutting against the surface 42 of the transfer belt 35. The pre-brush bias applicator 44*c* applies a bias to the pre-brush 39. The pre-brush 39 is used to preliminarily clean off the surface 42 of the transfer belt 35, to adjust the chargeability of residual toner on the surface 42 of the transfer belt 35, and for other applications.

The cleaning blade 40*a* is placed downstream of the pre-brush 39 and is also placed opposite to the driving roller 41*a* with respect to the transfer belt 35. From a different viewpoint, the cleaning blade 40*a* is placed upstream of the yellow developing unit 32*a*. The cleaning blade 40*a* is a long thin rubber-like plate member with elasticity. The cleaning blade 40*a* is attached so that its longitudinal direction is oriented along the main scan direction of the digital multifunction peripheral 11*a*. The top end of the cleaning blade 40*a* abuts against the surface 42 of the transfer belt 35 in a so-called counter direction. The cleaning blade 40*a*, secured at a specified place, physically removes toner adhering to the surface 42 of the unidirectionally rotating transfer belt 35. The material of the cleaning blade 40*a* may be, for example, polyurethane rubber.

When the digital multifunction peripheral 11*a* forms an image on a sheet of paper, a toner image primarily transferred onto the transfer belt 35 is transferred onto a transported sheet of paper, and then is fixed by the fuser unit (not shown). The sheet with the fixed image is ejected out of the digital multifunction peripheral 11*a*, more specifically, onto an ejection tray 30. After the toner image is transferred onto the sheet of paper, residual toner on the transfer belt 35 is physically removed by the cleaning blade 40*a*. Subsequently, the next image forming operation is performed.

The digital multifunction peripheral 11*a* has a capability of performing monochrome printing by using only the black developing unit 32*d*. Similarly, the digital multifunction peripheral 11*a* can perform color printing by using at least one of the yellow developing unit 32*a*, magenta developing unit 32*b*, and cyan developing unit 32*c*.

The digital multifunction peripheral 11*a* also includes an absolute moisture measuring unit 20 that measures absolute moisture content in an environment where the digital multifunction peripheral 11*a* is installed. Specifically, the digital multifunction peripheral 11*a* includes a thermo-hygrometer (not shown) that measures temperature and humidity of an environment where the digital multifunction peripheral 11*a* is installed. The thermo-hygrometer measures the temperature and humidity of the environment around the digital multifunction peripheral 11*a*, and the absolute moisture content is calculated based on the measured temperature and humidity.

Figure 4:
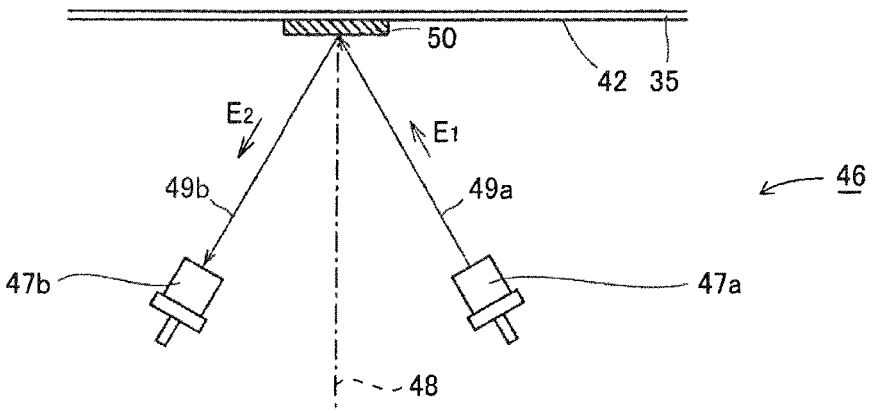
FIG. 4 is an external view schematically showing the configuration of a toner-amount detection sensor.

Next, a brief description about the configuration of the toner-amount detection sensor 46 will be given. FIG. 4 is a schematic view showing the configuration of the toner-amount detection sensor 46.

Referring to FIGS. 1 to 4, the toner-amount detection sensor 46 is placed downstream of the black developing unit 32*d* along the rotational direction of the transfer belt 35. The toner-amount detection sensor 46 includes a light-emitting element 47*a* that emits light toward the surface 42 of the transfer belt 35, a light-receiving element 47*b* that receives the reflected light from the surface 42 of the transfer belt 35, and a toner amount calculating unit (not shown) that calculates an amount of toner from the amount of the reflected light received by the light-receiving element 47*b*. In this embodiment, the light-emitting element 47*a* and the light-receiving element 47*b* are symmetrically placed with respect to a plane 48 extending perpendicular to the surface 42 of the transfer belt 35. This means that the light-receiving element 47*b* is placed so as to receive the light that is emitted from light-emitting element 47*a* and is specularly reflected. As a specific example, the light-emitting element 47*a* may be an infrared-emitting diode that emits infrared light. As a specific example, an infrared-receiving element may be employed for the light-receiving element 47*b*.

The light-emitting element 47*a* emits light 49*a*, or infrared light, in a slanting direction to the upper left as indicated by an arrow E1, toward the surface 42 of the transfer belt 35 or a toner image 50. When the toner image 50 is not formed, the light-emitting element 47*a* naturally emits light 49*a* toward the surface 42 of the transfer belt 35.

The light-receiving element 47*b* receives light 49*b*, which is reflected and travels in a slanting direction to the lower left as indicated by an arrow E2 in FIG. 4, from one of the toner image 50 and the surface 42 of the transfer belt 35 or from both the toner image 50 and the surface 42 of the transfer belt 35. If the toner image 50 entirely covers the surface 42 of the transfer belt 35, the light-receiving element 47*b* receives only reflected light 49*b* from the toner image 50. If the toner image 50 is not formed on the surface 42 of the transfer belt 35, the light-receiving element 47*b* receives only reflected light 49*b* from the surface 42 of the transfer belt 35. If the toner image 50 does not entirely cover the surface 42 of the transfer belt 35 and contains a small amount of toner, the light-receiving element 47*b* receives light 49*b* reflected from both the toner image 50 and the surface 42 of the transfer belt 35.

The toner-amount detection sensor 46 emits light 49*a* in the direction indicated by the arrow E1 in FIG. 4 toward the transfer belt 35 with the toner image 50 formed on the surface 42. The light 49*a* strikes one of the toner image 50 and the surface 42 of the transfer belt 35 or both the toner image 50 and the surface 42 of the transfer belt 35, and is then reflected. The reflected light 49*b* is received by the light-receiving element 47*b*. The light-receiving element 47*b* outputs current in accordance with the amount of the received light. The current output by the light-receiving element 47*b* is converted into a voltage value by a toner amount calculating unit. The amount of toner is calculated based on this voltage value. In this manner, the toner-amount detection sensor 46 detects the amount of toner. The control unit 12*a* uses the toner-amount detection sensor 46 to adjust the toner density, misalignment, and the like for images to be formed.

Figure 5:
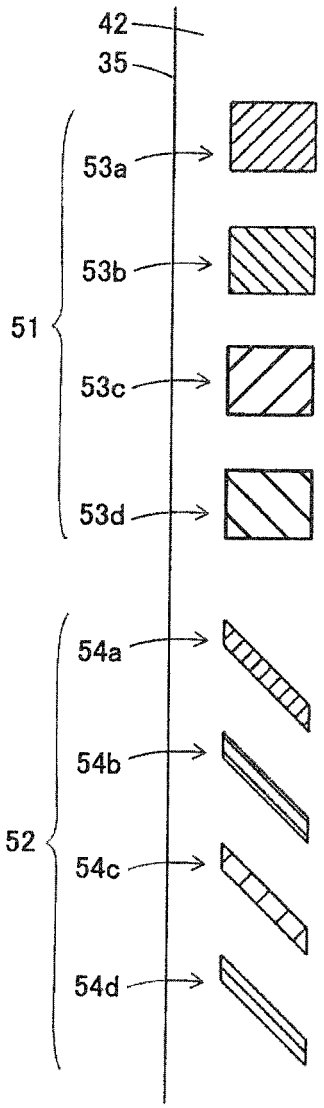
FIG. 5 illustrates patch images used to adjust misalignment for images to be formed.

Next, a brief description will be made about patch images formed to adjust misalignment for images to be formed. FIG. 5 illustrates patch images used to adjust misalignment for images to be formed. Referring to FIG. 5, a set 51 of rectangular patch images of different colors and a set 52 of parallelogram patch images of different colors are formed for the purpose of adjusting the misalignment for images to be formed. The patch image set 51 includes a rectangular yellow patch image 53*a*, a rectangular magenta patch image 53*b*, a rectangular cyan patch image 53*c*, and a rectangular black patch image 53*d*. These rectangular patch images 53*a* to 53*d* are formed in the following order from the upstream side: the yellow patch image 53*a*, magenta patch image 53*b*, cyan patch image 53*c*, and black patch image 53*d*. The parallelogram patch image set 52 includes a parallelogram yellow patch image 54*a*, a parallelogram magenta patch image 54*b*, a parallelogram cyan patch image 54*c*, and a parallelogram black patch image 54*d*. Similar to the rectangular patch images 53*a* to 53*d*, the parallelogram patch images 54*a* to 54*d* are formed in the following order: the yellow patch image 54*a*, magenta patch image 54*b*, cyan patch image 54*c*, and black patch image 54*d*. The patch images 53*a* to 53*d* and 54*a* to 54*d* are provided at predetermined intervals in a sub-scan direction, which is equal to the rotational direction of the transfer belt 35 in the digital multifunction peripheral 11*a*.

The digital multifunction peripheral 11*a* forms these patch images 53*a* to 53*d* and 54*a* to 54*d* at predetermined timings, for example, when 10,000 sheets of paper are printed or when any of the developing units 32*a* to 32*d* is replaced. The control unit 12*a* uses the toner-amount detection sensor 46 to detect the positions where the patch images 53*a* to 53*d* and 54*a* to 54*d* are formed, more specifically, the position where to start forming the patch images 53*a* to 53*d* and 54*a* to 54*d* and the position where to finish forming the patch images 53*a* to 53*d* and 54*a* to 54*d* in the sub-scan direction, and the positions where the patch images 53*a* to 53*d* and 54*a* to 54*d* are formed along the main scan direction. The control unit 12*a* adjusts the misalignment for images to be formed based on the detection results. Specifically, for example, if the patch images 53*a* to 53*d* and 54*a* to 54*d* are formed at different positions by more than a predetermined threshold value, the positions are corrected by adjusting the exposure timing or taking other measures to properly align the patch images 53*a* to 53*d* and 54*a* to 54*d*.

The patch images 53*a* to 53*d* and 54*a* to 54*d* formed to adjust the misalignment for images to be formed will never be transferred onto paper. This means that the toner that has been used to form the patch images 53*a* to 53*d* and 54*a* to 54*d* and remains on the surface 42 of the transfer belt 35 is removed from the surface 42 of the transfer belt 35. Note that since the patch images 53*a* to 53*d* and 54*a* to 54*d* are formed with electrically charged toner, the patch images 53*a* to 53*d* and 54*a* to 54*d* electrically and also physically adhere to the surface 42 of the transfer belt 35.

Next, a description will be made on how the digital multifunction peripheral 11*a* according to the embodiment of the disclosure removes residual toner on the surface 42 of the transfer belt 35.

Figure 6:
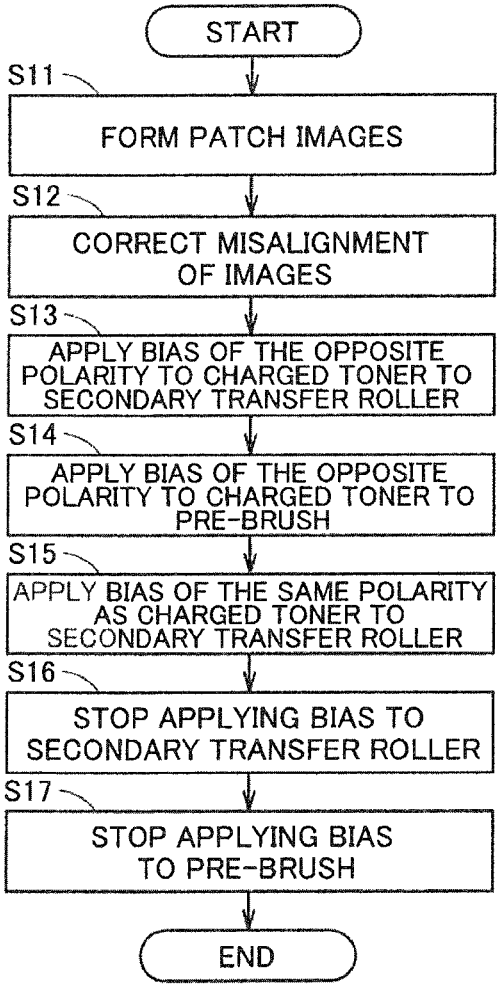
FIG. 6 is a flow chart describing an operational procedure to remove toner that has been used to form the patch images shown in FIG. 5 and remains on a surface of a transfer belt.
Figure 7:
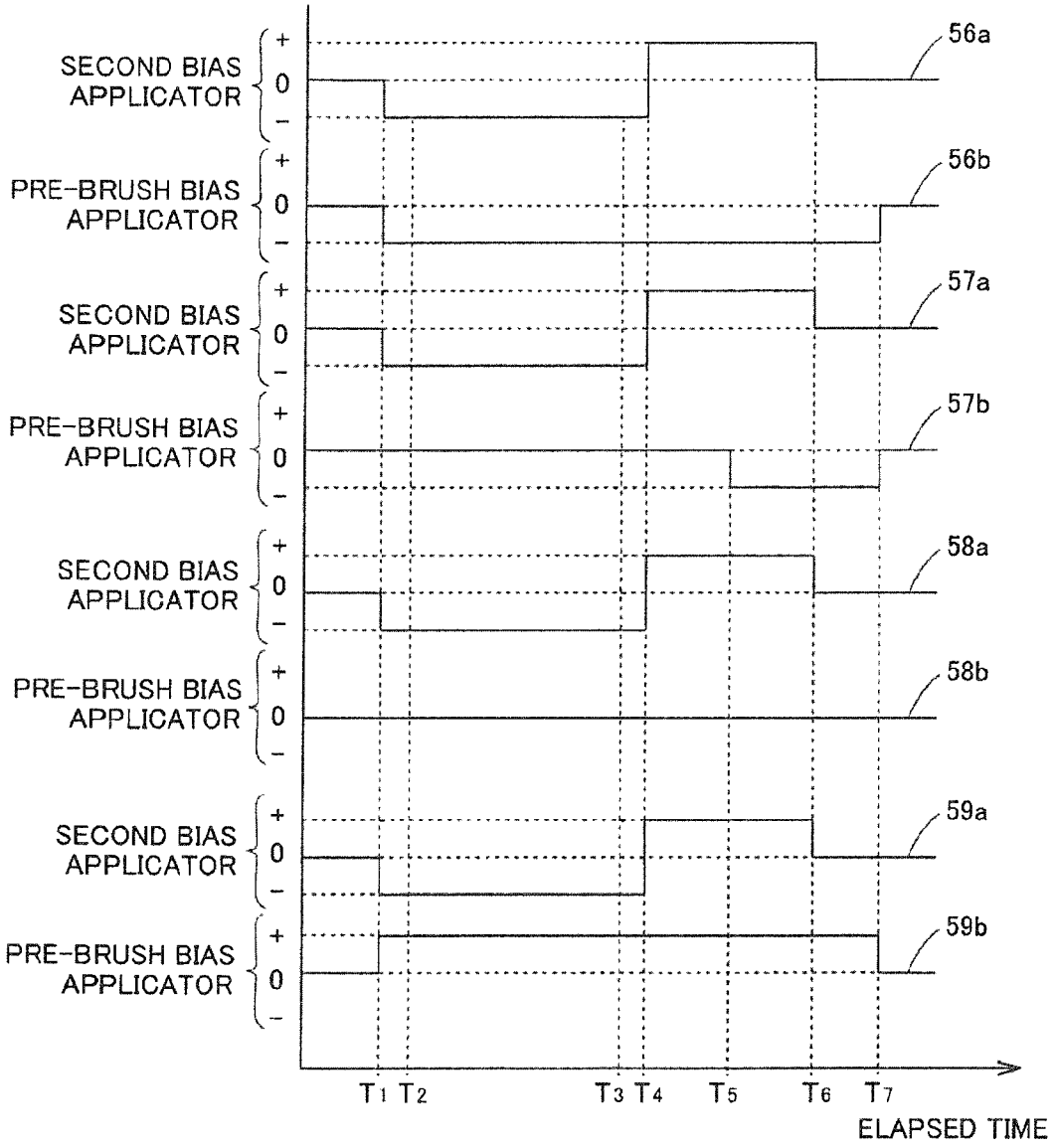
FIG. 7 is a graph showing the relationship between time elapsed and bias applied to a secondary transfer roller and pre-brush during the procedure in FIG. 6.

FIG. 6 is a flow chart describing an operational procedure to remove toner that has been used to form patch images 53*a* to 53*d* and 54*a* to 54*d* and remains on the surface 42 of the transfer belt 35. FIG. 7 is a graph showing the relationship between time elapsed and bias applied to the secondary transfer roller 38 and pre-brush 39 when the procedure in FIG. 6 is executed. The horizontal axis in FIG. 7 represents time elapsed. In FIG. 7, time runs from the left to the right. The vertical axis in FIG. 7 represents the polarities of the applied bias, more specifically, that the applied bias has positive polarity (+) or negative polarity (−), or no bias is applied. A numerical value of "0" indicates that no bias is applied. A line 56*a* in FIG. 7 indicates a bias applied to the secondary transfer roller 38, while a line 56*b* indicates a bias applied to the pre-brush 39. In this description, the toner is triboelectrically charged positively in the developing units 32*a* to 32*d*, that is, the toner has positive polarity.

Referring to FIGS. 6 and 7, patch images 53*a* to 53*d* and 54*a* to 54*d* are formed on the transfer belt 35 (step S11 in FIG. 6, hereinafter, "step" is omitted). More specifically, electrostatic latent images corresponding to the patch images 53*a* to 53*d* and 54*a* to 54*d* are formed on the photoreceptors 31*a* to 31*d*. Subsequently, the developing units 32*a* to 32*d* apply toner to the electrostatic latent images to form positively charged toner images on the photoreceptors 31*a* to 31*d*, respectively. The first bias applicator 44*a* then applies a predetermined bias to each of the primary transfer rollers 36*a* to 36*d* to primarily transfer the formed toner images onto the transfer belt 35.

With the use of the patch images 53*a* to 53*d* and 54*a* to 54*d*, primarily transferred onto the surface 42 of the transfer belt 35, the misalignment is corrected using the toner-amount detection sensor 46 for images to be formed (S12). The misalignment correction is made as follows. The transfer belt 35 rotates to successively bring the patch images 53*a* to 53*d* and 54*a* to 54*d* that have been primarily transferred thereon to a position where the toner-amount detection sensor 46 can detect them. Then, the toner-amount detection sensor 46 detects the positions where the patch images 53*a* to 53*d* and 54*a* to 54*d* are formed, and other factors. Based on the positions and other factors detected by the toner-amount detection sensor 46, the control unit 12*a* makes correction of misalignment for images to be formed.

The rotation of the transfer belt 35 then brings the toner that forms the patch images 53*a* to 53*d* and 54*a* to 54*d* to the position 45*a* where the secondary transfer roller 38 abuts against the surface 42 of the transfer belt 35. The second bias applicator 44*b* applies to the secondary transfer roller 38 a bias of the opposite polarity to the charged toner at time T1 that comes before time T2 at which the toner forming the patch images 53*a* to 53*d* and 54*a* to 54*d* arrives at the position 45*a* (S13). In this embodiment, the secondary transfer roller 38 is biased negatively since the toner is positively charged. More concretely, the bias applied to the secondary transfer roller 38 is a current value of −40 μA. Also at this stage, that is, at time T1, the pre-brush bias applicator 44*c* applies to the pre-brush 39 a bias of the opposite polarity to the charged toner (S14). More concretely, the bias applied to the secondary transfer roller 38 is a current vale of −5 μA. Steps S13 and S14 can be performed concurrently or at slightly different times.

The toner forming the patch images 53*a* to 53*d* and 54*a* to 54*d* successively arrives at the position 45*a*. Since the secondary transfer roller 38 is biased negatively by the second bias applicator 44*b*, the amount of charge of the positively-charged toner adhering to the surface 42 of the transfer belt 35 is reduced. In short, the polarity of the positively-charged toner electrically approaches 0. This makes electrical adhesion of the toner to the transfer belt 35 small.

The rotation of the transfer belt 35 then brings the toner that forms the patch images 53*a* to 53*d* and 54*a* to 54*d* to a position 45*b* where the pre-brush 39 is placed. Since the pre-brush 39 is biased negatively by the pre-brush bias applicator 44*c*, the amount of charge of the toner is further reduced. In short, the polarity of the positively-charged toner further electrically approaches 0. This makes electrical adhesion of the toner to the transfer belt 35 still smaller.

The rotation of the transfer belt 35 then brings the toner that forms the patch images 53*a* to 53*d* and 54*a* to 54*d* to a position 45*c* where the cleaning blade 40*a* is placed. At this stage, since the polarity of the positively-charged toner is considerably close to 0, the electrical adhesion between the toner and transfer belt 35 is greatly reduced. In other words, the toner adheres to the transfer belt 35 only with weak electrical adhesion and weak physical adhesion. Therefore, physical removal by the cleaning blade 40*a* can easily clean off the toner from the transfer belt 35. Thus, the toner primarily transferred onto the transfer belt 35 can be physically and efficiently removed by the cleaning blade 40*a* from the transfer belt 35.

When the patch images 53*a* to 53*d* and 54*a* to 54*d* pass through the position 45*a*, some toner may adhere to the secondary transfer roller 38 that abuts against the transfer belt 35. A description will be made about a procedure to remove toner adhering to the secondary transfer roller 38 after the patch images 53*a* to 53*d* and 54*a* to 54*d* pass through the position 45*a*. The control operations described so far are referred to as a first control, and control operations, which will be described hereinafter, are referred to as a second control.

The second bias applicator 44*b* applies a bias of the same polarity as the charged toner to the secondary transfer roller 38 at time T4 that comes after time T3 at which the toner forming the patch images 53*a* to 53*d* and 54*a* to 54*d* passes through the position 45*a* (S15). In this embodiment, the secondary transfer roller 38 is biased positively. More concretely, the bias applied to the secondary transfer roller 38 is a current value of +20 μA. Since the polarities of the toner and the secondary transfer roller 38 repel each other, the toner is transferred from the secondary transfer roller 38 to the transfer belt 35. This is referred to as retransfer.

The toner retransferred onto the transfer belt 35 arrives at the position 45*b* where the pre-brush 39 is placed with the rotation of the transfer belt 35. Since the pre-brush bias applicator 44*c* has been applying a negative bias to the pre-brush 39 since time T1, the amount of charge of the retransferred toner is reduced. In short, the polarity of the positively-charged retransferred toner electrically approaches 0. This makes electrical adhesion of the toner to the transfer belt 35 small.

The rotation of the transfer belt 35 then brings the toner that forms the patch images 53*a* to 53*d* and 54*a* to 54*d* to the position 45*c* where the cleaning blade 40*a* is placed. At this stage, since the polarity of the positively-charged toner is close to 0, the electrical adhesion of the toner to the transfer belt 35 is greatly reduced. In other words, the toner adheres to the transfer belt 35 only with weak electrical adhesion and weak physical adhesion. Therefore, physical removal by the cleaning blade 40*a* can easily clean off the retransferred toner from the transfer belt 35. Thus, the toner transferred from the secondary transfer roller 38 to adhere to the transfer belt 35 can be physically and efficiently removed by the cleaning blade 40*a* from the transfer belt 35.

After the removal of the toner, the application of the bias to the secondary transfer roller 38 is stopped at time T6 (S16), and the application of the bias to the pre-brush 39 is stopped at time T7 after time T6 (S17).

To remove toner that has been primarily transferred onto the transfer belt 35, the digital multifunction peripheral 11*a* performs the first control in which the second bias applicator 44*b* applies to the secondary transfer roller 38 a bias of the opposite polarity to the charged toner when the toner passes through the position 45*a* where the secondary transfer roller 38 is placed. The first control can reduce the electrical adhesion of the toner, which has been primarily transferred onto the transfer belt 35, to the transfer belt 35. Thus, the toner primarily transferred onto the transfer belt 35 can be physically and efficiently removed by the cleaning blade 40*a* from the transfer belt 35. After the first control, the digital multifunction peripheral 11*a* performs the second control in which the second bias applicator 44*b* applies to the secondary transfer roller 38 a bias of the same polarity as the charged toner and the pre-brush bias applicator 44*c* applies to the pre-brush 39 a bias of the opposite polarity to the toner. The second control can make the toner, which has physically adhered to the secondary transfer roller 38 when passing through the position 45*a* where the secondary transfer roller 38 is placed, electrically and efficiently adhere to the transfer belt 35. The pre-brush 39 that is placed downstream of the secondary transfer roller 38 receives a bias of the opposite polarity to the toner adhering to the transfer belt 35, and therefore can reduce the electrical adhesion of the toner to the transfer belt 35. Thus, the toner transferred from the secondary transfer roller 38 onto the transfer belt 35 can be physically and efficiently removed by the cleaning blade 40*a* from the transfer belt 35. Resultantly, residual toner on the transfer belt 35 can be efficiently removed with a simple configuration.

This configuration does not forcibly make the toner adhere to the secondary transfer roller 38 to then retransfer the toner to the transfer belt 35 for the subsequent toner removal, and therefore can greatly reduce the risk of contamination of the secondary transfer roller 38. For example, even if a foam rubber roller is employed as the secondary transfer roller 38, the risk of clogging pores in a surface of the foam rubber roller with toner can be avoided.

In the above-described embodiment, a bias is applied to the pre-brush 39 as a bias is applied to the secondary transfer roller 38; however, the present disclosure is not limited thereto. The application of a bias to the pre-brush 39 can be performed when toner passes through the position 45*b*, but not when a bias is applied to the secondary transfer roller 38.

Returning to FIG. 7, a line 57*a* indicates a bias applied to the secondary transfer roller 38, while a line 57*b* indicates a bias applied to the pre-brush 39, both the lines are seen in the above case.

As described above, the second bias applicator 44*b* applies a negative bias to the secondary transfer roller 38 at time T1. At time T1, the pre-brush bias applicator 44*c* does not apply a bias to the pre-brush 39. In other words, the pre-brush 39 is not biased at this point in time.

After the second bias applicator 44*b* applies a bias of the same polarity as the toner to the secondary transfer roller 38 at time T4, the pre-brush bias applicator 44*c* applies a bias of the opposite polarity to the toner to the pre-brush 39 at time T5 that corresponds to the time required for the transfer belt 35 to move from the position 45*a* to the position 45*b* at a predetermined rotational speed. The application of the bias to the secondary transfer roller 38 is stopped at time T6, and the application of the bias to the pre-brush 39 is stopped at time T7 as described in S16 and S17.

Accordingly, the electrical adhesion of the toner to the transfer belt 35 can be efficiently reduced in consideration of the case where the secondary transfer roller 38 rotates a plurality of times.

With reference to the above-described configuration, we evaluated the effect of the toner removal performed by the digital multifunction peripheral 11*a* equipped with the image forming unit 15*a* shown in FIG. 3.

The digital multifunction peripheral 11*a* was placed in an environment at a temperature of 10° C. and a humidity of 15%. The absolute moisture content determined by the absolute moisture measuring unit 20 based on the temperature and humidity was 1.4 g/m3. Toner used herein was positively-charged toner. Specifically, the amount of charge on the toner used herein was +30 to +40 μC/g. The linear velocity of the transfer belt 35 was 250 mm/sec. The material of the pre-brush 39 was electrically conductive nylon (330 D/kF, 120 kF/inch2). The material of the cleaning blade 40*a* was polyurethane rubber. As the secondary transfer roller 38, an electrically conductive foam rubber roller was used.

The following are the conditions of the experiment. The digital multifunction peripheral 11*a* used in this experiment has already formed a certain number of images on paper. The bias current to be applied to the secondary transfer roller 38 during secondary transfer of images to paper was set to −40 μA. Under these conditions, patch images 53*a* to 53*d* and 54*a* to 54*d* in a single color, yellow, magenta, cyan, or black, were transferred onto the transfer belt 35. From time T1 to time T7, as shown in FIG. 7, the patch images on the transfer belt 35 were carried to pass through the position 45*a* where the secondary transfer roller 38 was placed, in a no-paper state, that is, without feeding paper, and a bias was applied to the secondary transfer roller 38 and pre-brush 39. After this process, paper was fed to check if the paper was soiled. The evaluation results are shown in Table 1.

TABLE 1

| | VALUES OF BIAS CURRENT APPLIED TO PRE-BRUSH | VALUES OF BIAS CURRENT APPLIED TO SECONDARY TRANSFER ROLLER | TONER CONTAM-INATION |
|---|---|---|---|
| EXAMPLE 1 | −5 μA | −60 μA | NO |
| COMPARATIVE EXAMPLE 1 | +10 μA | −40 μA | YES |
| COMPARATIVE EXAMPLE 2 | 0 | −40 μA | YES |
| COMPARATIVE EXAMPLE 3 | +5 μA | +20 μA | YES |

Referring to Table 1, the bias current applied to the secondary transfer roller 38 in Example 1 is set to −60 μA (microampere) and has the opposite polarity to the positively-charged toner. The bias current applied to the pre-brush 39 is set to −5 μA and has the opposite polarity to the positively-charged toner. Controlling the bias current as described above does not cause toner contamination. The application of the bias current in Example 1 is controlled as indicated by a line 56*a* and a line 56*b* in FIG. 7.

In Comparative Example 1, the bias current applied to the secondary transfer roller 38 is set to −40 μA and has the opposite polarity to the positively-charged toner. The bias current applied to the pre-brush 39 is set to +10 μA and has the same polarity as the positively-charged toner. Controlling the bias current as described above causes toner contamination.

Similar to Comparative Example 1, the bias current applied to the secondary transfer roller 38 in Comparative Example 2 is set to −40 μA and has the opposite polarity to the positively-charged toner. However, a bias is not applied to the pre-brush 39. Controlling the bias current as described above also causes toner contamination. The application of the bias in Comparative Examples 2 and 4, which will be described later, is controlled as indicated by a line 58*a* and a line 58*b* in FIG. 7.

In Comparative Example 3, the bias current applied to the secondary transfer roller 38 is set to +20 μA and has the same polarity as the positively-charged toner. The bias current applied to the pre-brush 39 is set to +5 μA and has the same polarity as the positively-charged toner. Controlling the bias current as described above also causes toner contamination.

Next, a description will be made about values of bias current applied to the pre-brush 39. The description also includes removal of retransferred toner. The following are the conditions of an experiment. The digital multifunction peripheral 11*a* used in this experiment has already formed a certain number of images on paper. The value of the bias current applied to the secondary transfer roller 38 during second transfer of images to paper was set to −40 μA. Under these conditions, patch images 53*a* to 53*d* and 54*a* to 54*d* in a single color, yellow, magenta, cyan, or black, were transferred onto the transfer belt 35. From time T1 to time T7, as shown in FIG. 7, the patch images on the transfer belt 35 were carried to pass through the position 45*a* where the secondary transfer roller 38 was placed, in a no-paper state, that is, without feeding paper, and a bias was applied to the secondary transfer roller 38 and pre-brush 39. In this experiment, all values of bias current applied to the secondary transfer roller 38 at time T4 to retransfer the toner to the transfer belt 35 were set to +20 μA. After this process, paper was fed to check if the paper was soiled. The evaluation results are shown in Table 2.

TABLE 2

| | VALUES OF BIAS CURRENT APPLIED TO PRE-BRUSH | TONER CONTAM-INATION |
|---|---|---|
| EXAMPLE 2 | −10 μA | NO |
| EXAMPLE 3 | −5 μA | NO |
| COMPARATIVE EXAMPLE 4 | 0 | YES |
| COMPARATIVE EXAMPLE 5 | +5 μA | YES |
| COMPARATIVE EXAMPLE 6 | +10 μA | YES |

Referring to Table 2, the bias current applied to the pre-brush 39 in Example 2 is set to −10 μA and has the opposite polarity to the positively-charged toner. Controlling the bias current as described above does not cause toner contamination. In Example 3, the bias current applied to the pre-brush 39 is set to −5 μA and has the opposite polarity to the positively-charged toner. Controlling the bias current as described above does not cause toner contamination.

On the other hand, toner contamination occurs when no bias is applied to the pre-brush 39 as shown in Comparative Example 4, when the bias current applied to the pre-brush 39 is set to +5 μA and has the same polarity as the positively-charged toner as shown in Comparative Example 5, and when the bias current applied to the pre-brush 39 is set to +10 μA and has the same polarity as the positively-charged toner as shown in Comparative Example 6. The application of the bias in Comparative Examples 5 and 6 is controlled as indicated by a line 59*a* and a line 59*b* in FIG. 7.

Next, a description will be made about values of bias current applied to the secondary transfer roller 38. The following are the conditions of an experiment. The digital multifunction peripheral 11*a* used in this experiment has already formed a certain number of images on paper. Under these conditions, patch images 53*a* to 53*d* and 54*a* to 54*d* in a single color, yellow, magenta, cyan, or black, were transferred onto the transfer belt 35. From time T1 to time T7, as shown in FIG. 7, a bias was applied to the secondary transfer roller 38 and pre-brush 39. In this experiment, the values of the bias current applied to the secondary transfer roller 38 at time T4 to retransfer the toner onto the transfer belt 35 were set to +20 μA. Then, the patch images were carried to pass through the position 45*a* where the secondary transfer roller 38 was placed in a no-paper state, that is, without feeding paper. After this process, paper was fed to check if the paper was soiled. The evaluation results are shown in Table 3.

TABLE 3

| | VALUES OF BIAS CURRENT APPLIED TO SECONDARY TRANSFER ROLLER | NUMBER OF ROTATIONS REQUIRED TO REMOVE TONER CONTAM-INATION |
|---|---|---|
| EXAMPLE 4 | −20 μA | 5 |
| EXAMPLE 5 | −30 μA | 3 |
| EXAMPLE 6 | −40 μA | 3 |
| EXAMPLE 7 | −50 μA | 3 |
| EXAMPLE 8 | −60 μA | 3 |

Referring to Table 3, the value of bias current applied to the secondary transfer roller 38 at time T1 is set to −20 μA in Example 4, −30 μA in Example 5, −40 μA in Example 6, −50 μA in Example 7, and −60 μA in Example 8. Table 3 also indicates the number of rotations of the secondary transfer roller 38.

The secondary transfer roller 38 in Example 4 rotates five times, but rotates three times in Examples 5 to 8. The number of rotations is preferable to be as few as possible. The fewer the number of rotations is, the sooner the toner contamination can be removed. Therefore, a preferable value of bias current to be applied to the secondary transfer roller 38 is −40 μA or lower so as to reliably remove contamination within a few rotations, which is three times. The current value of −40 μA is also used to transfer toner onto paper. Specifically, the control unit 12*a* serves as the first control unit to control the absolute value of the bias applied by the second bias applicator 44*b* to be equal or lower than the absolute value of the bias applied during secondary transfer in which the toner is transferred onto paper as a recording medium.

In the above-described embodiment, the control unit 12*a* can be configured so as to serve as the first and second control units when the absolute moisture content is 1.4 g/m3 or lower. The amount of charge on toner naturally increases in such an environment, and therefore the electric adhesion of the toner to the transfer belt 35 is relatively enhanced. This is the reason to actuate the first and second control units in the environment.

Figure 8:
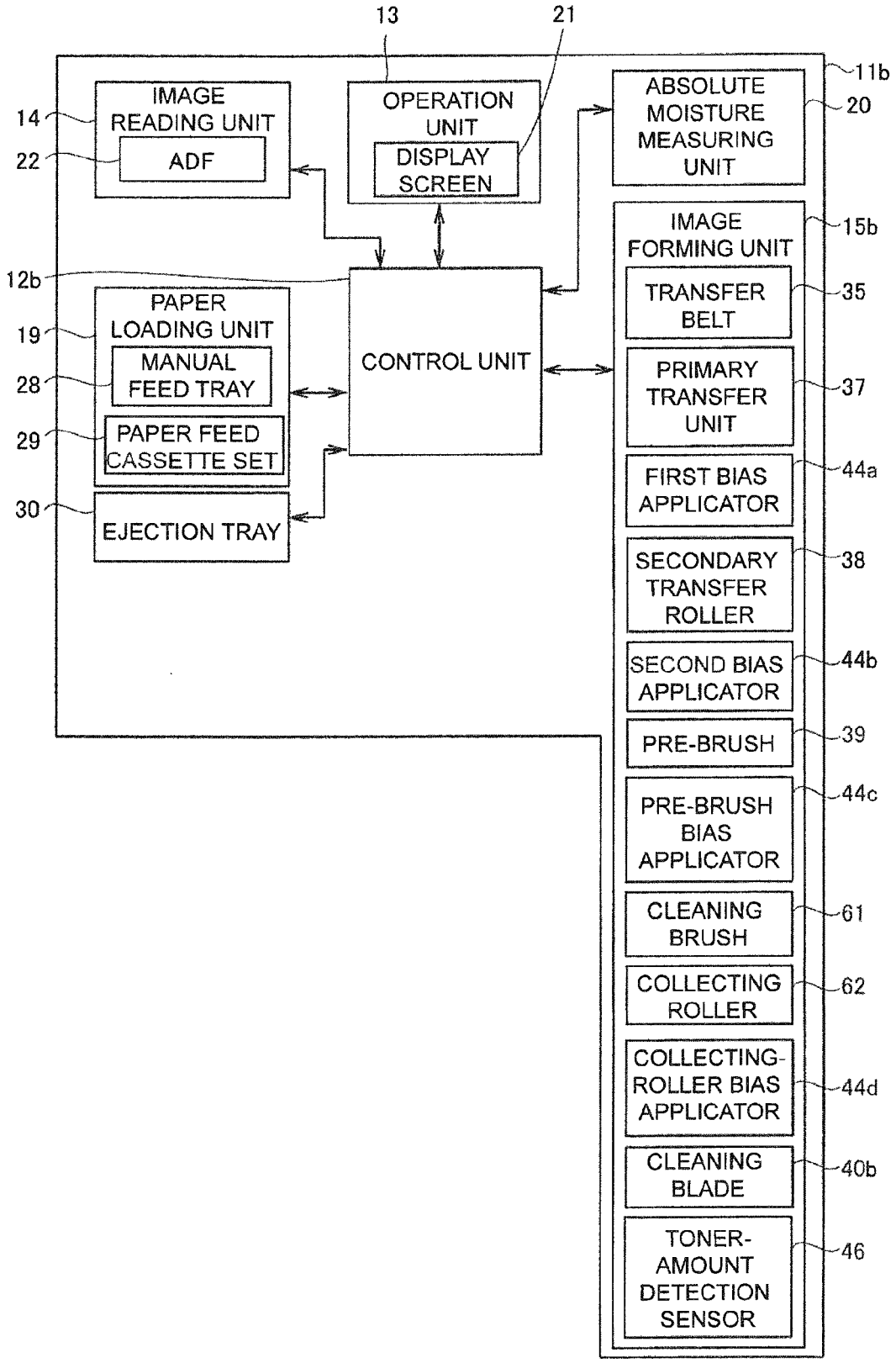
FIG. 8 is a block diagram showing a configuration of a digital multifunction peripheral to which an image forming apparatus according to another embodiment of the disclosure is applied.
Figure 9:
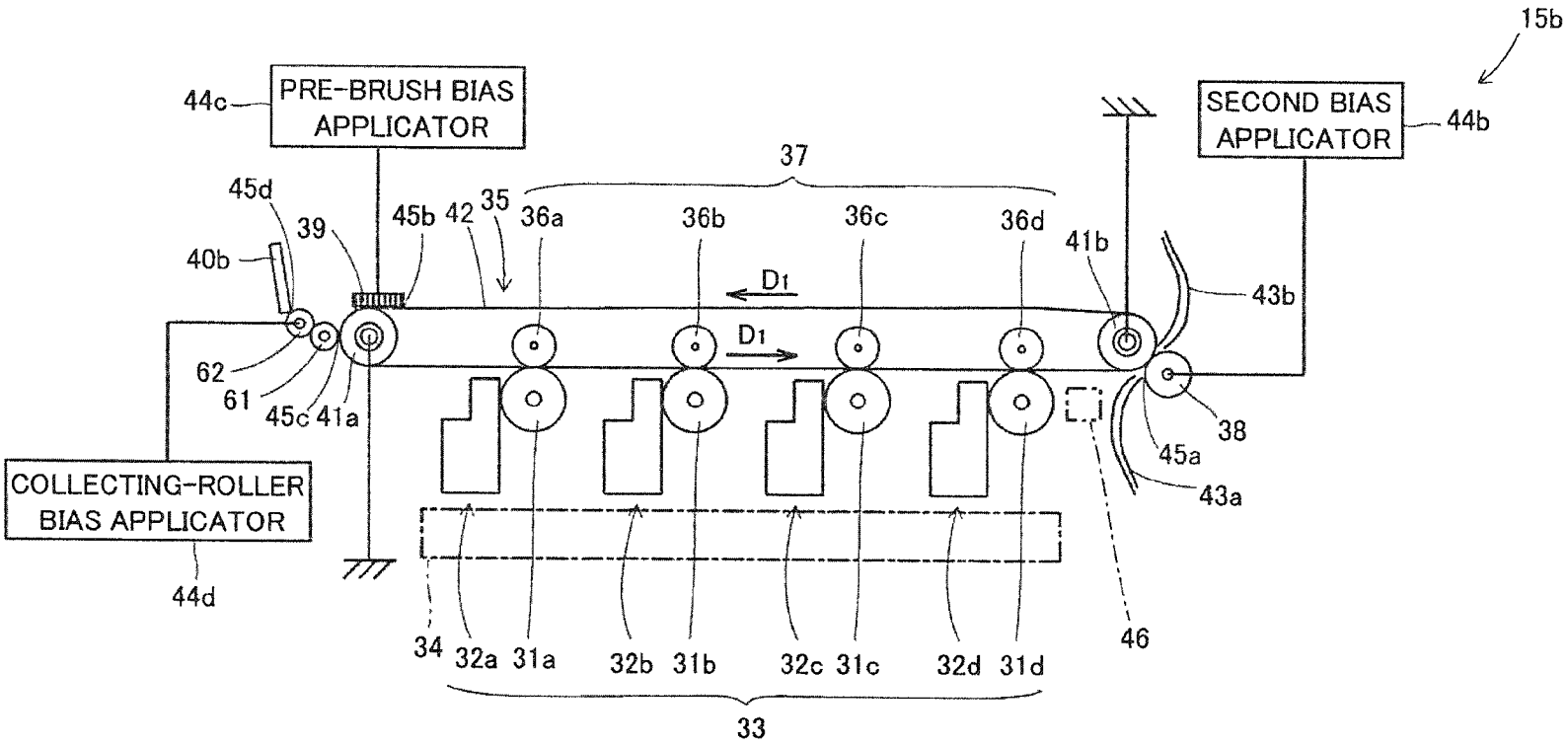
FIG. 9 illustrates a configuration of an image forming unit provided in the digital multifunction peripheral shown in FIG. 8.

Another embodiment of the present disclosure will be described. FIG. 8 is a block diagram showing a configuration of a digital multifunction peripheral 11*b* to which the image forming apparatus according to this embodiment of the disclosure is applied. FIG. 9 illustrates a configuration of an image forming unit 15*b* provided in the digital multifunction peripheral 11*b*. The description will be made mainly about the differences in configuration between the digital multifunction peripheral 11*b* according to this embodiment of the disclosure and the digital multifunction peripheral 11*a* shown in FIGS. 1 to 3, and therefore like components are denoted by like numerals and the description thereof will not be reiterated.

Referring to FIGS. 1 to 3, 8 and 9, the digital multifunction peripheral 11*b* according to the embodiment of the disclosure includes a control unit 12*b* serving as first and second control units and an image forming unit 15*b*. The image forming unit 15*b* includes a developing device 33, a laser scanner unit (LSU) 34, a transfer belt 35 serving as an intermediate transfer member, a primary transfer unit 37 including four primary transfer rollers 36*a*, 36*b*, 36*c*, 36*d*, a first bias applicator 44*a* that applies a bias to the four primary transfer rollers 36*a*, 36*b*, 36*c*, 36*d*, a secondary transfer roller 38, a second bias applicator 44*b* that applies a bias to the secondary transfer roller 38, a pre-brush 39, a pre-brush bias applicator 44*c* that applies a bias to the pre-brush 39, a cleaning brush 61, a collecting roller 62, a collecting-roller bias applicator 44*d*, a cleaning blade 40*b*, and a toner-amount detection sensor 46. The LSU 34 in FIG. 9 is schematically shown by a dot-and-dash line in like manner with FIG. 3. The toner-amount detection sensor 46 in FIG. 9 is schematically shown by a dashed double-dotted line in like manner with FIG. 3. The image forming unit 15*b* employed by the digital multifunction peripheral 11*b* is a so-called tandem process system using four colors.

The cleaning brush 61 is placed downstream of the pre-brush 39 and is also placed opposite to the driving roller 41*a* with respect to the transfer belt 35. The cleaning blade 40*b* is placed upstream of a yellow developing unit 32*a*. Similar to the pre-brush 39, the cleaning brush 61 is in the shape of a brush and has an end portion abutting against a surface 42 of the transfer belt 35.

The collecting roller 62 is placed so as to abut against the cleaning brush 61. The collecting roller 62 abuts against the cleaning brush 61 at a position 45*d* that is in a different position from a position 45*c* where the cleaning brush 61 abuts against the surface 42 of the transfer belt 35. Specifically, the position where the collecting roller 62 abuts against the cleaning brush 61 is nearly opposed to the position where the cleaning brush 61 abuts against the surface 42 of the transfer belt 35 with respect to the center of the cleaning brush 61.

The collecting-roller bias applicator 44*d* applies a bias to the collecting roller 62. The application of the bias produces a potential difference that causes charged toner to move from the cleaning brush 61 to the collecting roller 62.

The cleaning blade 40*b* is placed so as to abut against the collecting roller 62. The cleaning blade 40*b* is a long thin rubber-like plate member with elasticity. The cleaning blade 40*b* is attached so that its longitudinal direction is oriented along the main scanning direction of the digital multifunction peripheral 11*b*. The tip of the cleaning blade 40*b* abuts against a surface of the collecting roller 62 in a so-called counter direction. The cleaning blade 40*b* is secured at a specified place to physically remove toner adhering to the surface of the unidirectionally rotating collecting roller 62. The material of the cleaning blade 40*b* may be, for example, polyurethane rubber.

When the digital multifunction peripheral 11*b* forms an image on a sheet of paper, a toner image that has been secondarily transferred onto the transfer belt 35 is transferred onto a transported sheet of paper, and then is fixed by a fuser unit (not shown). The sheet with the fixed image is ejected out of the digital multifunction peripheral 11*b*, more specifically, onto an ejection tray 30. After the toner image is transferred onto the sheet of paper, residual toner on the transfer belt 35 is removed as if it is swept in a bristle part of the cleaning brush 61. The toner clinging to the cleaning brush 61 is collected by applying a bias to the collecting roller 62 that abuts against the cleaning brush 61 to make the toner electrically adhere to the surface of the collecting roller 62. The toner adhering to the surface of the collecting roller 62 is physically removed by the cleaning blade 40*b*. Subsequently, the next image forming operation is performed. This cleaning mechanism for the surface 42 of the transfer belt 35 using the cleaning brush 61 and collecting roller 62 reduces the risk of damaging the surface 42 of the transfer belt 35, thereby reducing a physical load on the surface 42 of the transfer belt 35.

Next, a description will be made on how the digital multifunction peripheral 11*b* according to the embodiment of the disclosure removes residual toner on the surface 42 of the transfer belt 35.

Figure 10:
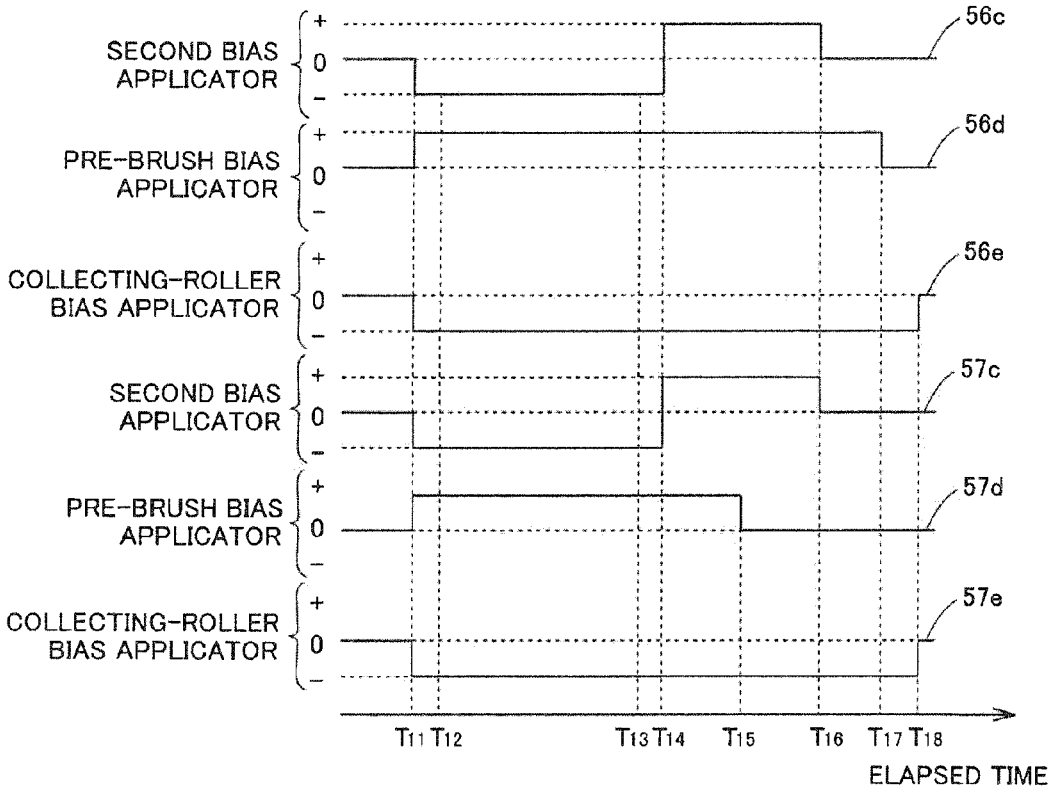
FIG. 10 is a graph showing the relationship between time elapsed and bias applied to a secondary transfer roller, pre-brush, and collecting roller during the procedure in FIG. 6.

FIG. 6 is, as described above, a flow chart describing an operational procedure to remove toner that has been used to form patch images 53*a* to 53*d* and 54*a* to 54*d* and remains on the surface 42 of the transfer belt 35. FIG. 10 is a graph showing the relationship between time elapsed and bias applied to the secondary transfer roller 38, pre-brush 39 and collecting roller 62 when the procedure in FIG. 6 is executed. The horizontal axis in FIG. 10 represents time elapsed. In FIG. 10, time runs from the left to the right. The vertical axis in FIG. 10 represents the polarities of the applied bias, more specifically, that the applied bias has positive polarity (+) or negative polarity (−), or no bias is applied. A numerical value of "0" indicates that no bias is applied. A line 56*c* in FIG. 10 indicates a bias applied to the secondary transfer roller 38, a line 56*d* indicates a bias applied to the pre-brush 39, and a line 56*e* indicates a bias applied to the collecting roller 62. In this description, the toner is triboelectrically charged positively in the developing units 32*a* to 32*d*, that is, the toner has positive polarity.

Referring to FIGS. 6 and 10, patch images 53*a* to 53*d* and 54*a* to 54*d* are formed on the transfer belt 35 (S11). More specifically, electrostatic latent images corresponding to the patch images 53*a* to 53*d* and 54*a* to 54*d* are firstly formed on the photoreceptors 31*a* to 31*d*. Subsequently, the developing units 32*a* to 32*d* apply toner to the electrostatic latent images to form positively charged toner images on the photoreceptors 31*a* to 31*d*, respectively. The first bias applicator 44*a* then applies a predetermined bias to each of the primary transfer rollers 36*a* to 36*d* to primarily transfer the formed toner images onto the transfer belt 35.

With the use of the patch images 53*a* to 53*d* and 54*a* to 54*d*, primarily transferred onto the surface 42 of the transfer belt 35, the misalignment is corrected using the toner-amount detection sensor 46 for images to be formed (S12). The misalignment correction is made as follows. The transfer belt 35 rotates to successively bring the patch images 53*a* to 53*d* and 54*a* to 54*d* that have been primarily transferred thereon to a position where the toner-amount detection sensor 46 can detect them. Then, the toner-amount detection sensor 46 detects the positions where the patch images 53*a* to 53*d* and 54*a* to 54*d* are formed, and other factors. Based on the positions and other factors detected by the toner-amount detection sensor 46, the control unit 12*b* makes correction of misalignment for images to be formed.

The rotation of the transfer belt 35 then brings the toner that forms the patch images 53*a* to 53*d* and 54*a* to 54*d* to the position 45*a* where the secondary transfer roller 38 abuts against the surface 42 of the transfer belt 35. The second bias applicator 44*b* applies to the secondary transfer roller 38 a bias of the opposite polarity to the charged toner at time T11 that comes before time T12 at which the toner forming the patch images 53*a* to 53*d* and 54*a* to 54*d* arrives at the position 45*a* (S13). In this embodiment, the secondary transfer roller 38 is biased negatively since the toner is positively charged. More concretely, for example, the bias applied to the secondary transfer roller 38 is a current value of −40 μA. At this stage, that is, at time T11, the pre-brush bias applicator 44*c* applies to the pre-brush 39 a bias that has the same polarity as the charged toner and an absolute value smaller than that of a bias applied by the secondary bias applicator 44*b* (S14). More concretely, for example, the bias applied to the pre-brush 39 is a current value of +5 μA. Steps S13 and S14 can be performed simultaneously or at slightly different times. At this stage, the collecting-roller bias applicator 44*d* applies a bias to the collecting roller 62. More concretely, for example, the bias applied to the collecting roller 62 is a current value of −10 μA.

The toner that forms the patch images 53*a* to 53*d* and 54*a* to 54*d* successively arrives at the position 45*a*. Since the secondary transfer roller 38 is biased negatively by the second bias applicator 44*b*, the amount of charge of the positively-charged toner is reduced. In short, the polarity of the positively-charged toner electrically approaches 0. This makes electrical adhesion of the toner to the transfer belt 35 small.

The rotation of the transfer belt 35 then brings the toner that forms the patch images 53*a* to 53*d* and 54*a* to 54*d* to the position 45*b* where the pre-brush 39 is placed. At this point, the pre-brush 39 is biased positively by the pre-brush bias applicator 44*c*. With the application of the positive bias, the toner, which was originally positively charged and then took on a negative charge during the application of the bias to the secondary transfer roller 38, can be again charged positively. In this case, since the pre-brush bias applicator 44*c* applies a bias whose absolute value is smaller than that of a bias applied by the second bias applicator 44*b*, most of the toner resultantly carries a small amount of positive charge. When the toner is moved past the position 45*b*, the charging performance of the toner is made uniform so that the toner weakly adheres to the transfer belt 35 with the small amount of electrically positive charge.

The rotation of the transfer belt 35 then brings the toner that forms the patch images 53*a* to 53*d* and 54*a* to 54*d* to the position 45*c* where the cleaning brush 61 is placed. At this stage, since the polarity of the positively-charged toner approaches 0, the electrical adhesion of the toner to the transfer belt 35 is greatly reduced. In other words, the toner adheres to the transfer belt 35 only with weak electrical adhesion provided by the positive charge and weak physical adhesion. Consequently, the toner adhering to the transfer belt 35 can be easily removed from the surface 42 of the transfer belt 35 by the cleaning brush 61.

The toner removed by the cleaning brush 61 is carried with rotation of the cleaning brush 61 to the position 45*d* where the cleaning brush 61 abuts against the collecting roller 62, while the toner remains positively charged. The collecting roller 62 is biased negatively by the collecting-roller bias applicator 44*d*. The negatively-biased collecting roller 62 that rotates in an opposite direction to the cleaning brush 61 electrically attracts the toner arriving at the position 45*d*. In short, the toner is electrically transferred from the cleaning brush 61 to the collecting roller 62.

The toner that has been electrically transferred onto a surface of the collecting roller 62 is physically removed by the cleaning blade 40*b* that abuts against the collecting roller 62. As described above, the toner adhering to the surface 42 of the transfer belt 35 passes through the cleaning brush 61 and collecting roller 62, and is removed by the cleaning blade 40*b*.

When the patch images 53*a* to 53*d* and 54*a* to 54*d* pass through the position 45*a*, some of the toner may adhere to the secondary transfer roller 38 because the secondary transfer roller 38 abuts against the transfer belt 35. A description will be made about a procedure to remove toner adhering to the secondary transfer roller 38 after the patch images 53*a* to 53*d* and 54*a* to 54*d* pass through the position 45*a*. The control operations described so far are referred to as the first control, and control operations that will be described hereinafter are referred to as the second control.

The second bias applicator 44*b* applies a bias of the same polarity as the charged toner to the secondary transfer roller 38 at time T14 that comes after time T13 at which the toner forming the patch images 53*a* to 53*d* and 54*a* to 54*d* passes through the position 45*a* (S15). In this embodiment, the secondary transfer roller 38 is biased positively. More concretely, the bias applied to the secondary transfer roller 38 is a current value of +20 μA. Since the polarities of the toner and the secondary transfer roller 38 repel each other, the toner is transferred from the secondary transfer roller 38 to the transfer belt 35. This is referred to as retransfer.

Subsequently, the retransferred toner arrives at the position 45*b* where the pre-brush 39 is placed with rotation of the transfer belt 35. The pre-brush 39 has been biased positively by the pre-brush bias applicator 44*c* since time T11, and therefore the charged toner remains charged positively. Thus, the polarity of the charged toner can never become negative.

The rotation of the transfer belt 35 then brings the toner that forms the patch images 53*a* to 53*d* and 54*a* to 54*d* to the position 45*c* where the cleaning brush 61 is placed. Since the toner at this stage has barely enough positive charge to electrically adhere to the transfer belt 35, physical removal by the cleaning brush 61 can easily remove the toner from the transfer belt 35. Thus, the toner transferred from the secondary transfer roller 38 onto the transfer belt 35 can be physically and efficiently removed by the cleaning brush 61 from the transfer belt 35.

The toner that has been removed by the cleaning brush 61 and remains charged positively is collected by the negatively-biased collecting roller 62. Then, the cleaning blade 40*b* removes the toner from the surface of the collecting roller 62.

After the removal of the toner, the application of the bias to the secondary transfer roller 38 is stopped at time T16 (S16), and the application of the bias to the pre-brush 39 is stopped at time T17 after time T16 (S17). When time T18 comes after a predetermined period of time has elapsed since the application of the bias to the pre-brush 39 was stopped, the application of the bias to the collecting roller 62 is stopped.

To remove toner that is primarily transferred onto the transfer belt 35, the digital multifunction peripheral 11*b* performs the first control in which the second bias applicator 44*b* applies to the secondary transfer roller 38 a bias of the opposite polarity to the charged toner when the toner passes through the position 45*a* where the secondary transfer roller 38 is placed. The first control can reduce the electrical adhesion of the toner, which is primarily transferred onto the transfer belt 35, to the transfer belt 35. The second bias applicator 44*c* applies to the pre-brush 39, which is placed downstream of the secondary transfer roller 38, a bias having the same polarity as the charged toner and an absolute value smaller than the bias applied by the second bias applicator 44*b*, thereby returning the toner polarity, which has been reversed when the toner passes through the position 45*a* where the secondary transfer roller 38 is placed, to its original. This can keep the toner, which is primarily transferred onto the transfer belt 35, adhering to the transfer belt 35 at a low charge level, thereby physically and efficiently removing the toner, which is primarily transferred onto the transfer belt 35, by the cleaning brush 61 from the transfer belt 35. After the first control, the second control is performed to apply a bias of the same polarity as the charged toner from the second bias applicator 44*b* to the secondary transfer roller 38. The second control can make the toner, which has physically adhered to the secondary transfer roller 38 when passing through the position 45*a* where the secondary transfer roller 38 is placed, electrically and efficiently adhere to the transfer belt 35. Thus, the toner transferred from the secondary transfer roller 38 to the transfer belt 35 can be physically and efficiently removed by the cleaning brush 61 from the transfer belt 35. Resultantly, residual toner on the transfer belt 35 can be efficiently removed with a simple configuration.

The digital multifunction peripheral 11*b* does not forcibly make the toner adhere to the secondary transfer roller 38 to retransfer the toner to the transfer belt 35 for the subsequent toner removal, thereby greatly reducing the risk of contamination of the secondary transfer roller 38. For example, even if a foam rubber roller is employed as the secondary transfer roller 38, the risk of clogging pores in a surface of the foam rubber roller with toner can be avoided.

In the above-described embodiment, the pre-brush 39 is biased together with the application of the bias to the secondary transfer roller 38; however, the present disclosure is not limited thereto. The pre-brush bias applicator 44*c* can be controlled so as to stop applying a bias of the same polarity as the toner to the pre-brush 39 after the lapse of a time period required for the toner, which has passed through the position 45*a* where the secondary transfer roller 38 is placed, to travel from the position 45*a* to the position 45*b* where the pre-brush 39 is placed.

Reference is again made to FIG. 10, a line 57*c* indicates a bias applied to the secondary transfer roller 38, a line 57*d* indicates a bias applied to the pre-brush 39, and a line 57*e* indicates a bias applied to the collecting roller 62. Those lines indicate the timing of applying bias in the above case.

The second bias applicator 44*b* applies a negative bias to the secondary transfer roller 38 at time T11. At time T11, the pre-brush bias applicator 44*c* also applies a bias to the pre-brush 39.

After the second bias applicator 44*b* applies a bias of the same polarity as the toner to the secondary transfer roller 38 at time T14, the pre-brush bias applicator 44*c* stops the application of the bias to the pre-brush 39 at time T15 at which the toner arrives at the position 45*b* from the position 45*a*. The application of the bias to the secondary transfer roller 38 is stopped at time T16, and the application of the bias to the pre-brush 62 is stopped at time T18 as with the case described above.

Accordingly, the electrical adhesion of the toner to the transfer belt 35 can be reduced in consideration of the case where the secondary transfer roller 38 rotates a plurality of times.

With reference to the above-described configuration, we evaluated the effect of the toner removal performed by the digital multifunction peripheral 11*b* equipped with the image forming unit 15*b* shown in FIG. 9.

The digital multifunction peripheral 11*b* was placed in an environment at a temperature of 10° C. and a humidity of 15%. The absolute moisture content at the temperature and humidity was 1.4 g/m3. Toner used herein was positively-charged toner. Specifically, the amount of charge on the toner used herein was +30 to +40 μC/g. The linear velocity of the transfer belt 35 was 250 mm/sec. The material of the pre-brush 39 was electrically conductive nylon (330 D/kF, 120 kF/inch2). The material of the collecting roller 62 was electrically conductive acrylic (330 T/kF, 100 kF/inch2). The material of the cleaning blade 40*a* was polyurethane rubber. As the secondary transfer roller 38, an electrically conductive foam rubber roller was used.

The following are the conditions of the experiment. The digital multifunction peripheral 11*b* used in this experiment has already formed a certain number of images on paper. The value of the bias current applied to the secondary transfer roller 38 during second transfer of images to paper was set to −40 μA. Under these conditions, patch images 53*a* to 53*d* and 54*a* to 54*d* in a single color, yellow, magenta, cyan, or black, were transferred onto the transfer belt 35. As shown in FIG. 10, from time T11 to time T18, the patch images on the transfer belt 35 were carried to pass through the position 45*a* where the secondary transfer roller 38 was placed, in a no-paper state, that is, without feeding paper, and the bias was applied to the secondary transfer roller 38, pre-brush 39, and collecting roller 62. After this process, paper was fed to check if the paper was soiled. The evaluation results are shown in Table 4.

TABLE 4

| | VALUES OF BIAS CURRENT APPLIED TO PRE-BRUSH | VALUES OF BIAS CURRENT APPLIED TO SECONDARY TRANSFER ROLLER | TONER CONTAM-INATION |
|---|---|---|---|
| EXAMPLE 9 | +5 μA | −20 μA | GOOD |
| EXAMPLE 10 | +5 μA | −40 μA | EXCELLENT |
| EXAMPLE 11 | +5 μA | −60 μA | EXCELLENT |
| EXAMPLE 12 | +10 μA | −40 μA | EXCELLENT |
| COMPARATIVE EXAMPLE 7 | 0 | +40 μA | POOR |
| COMPARATIVE EXAMPLE 8 | 0 | −40 μA | POOR |
| COMPARATIVE EXAMPLE 9 | +5 μA | +40 μA | POOR |

Referring to Table 4, the bias current applied to the secondary transfer roller 38 in Example 9 is set to −20 μA and has the opposite polarity to the positively-charged toner. The bias current applied to the pre-brush 39 is set to +5 μA and has the same polarity as the positively-charged toner. Controlling the bias values as such produces no toner contamination and provides a "good" evaluation result.

The bias current applied to the secondary transfer roller 38 in Example 10 is set to −40 μA and has the opposite polarity to the positively-charged toner. The bias current applied to the pre-brush 39 is set to +5 μA and has the same polarity as the positively-charged toner. Controlling the bias values as such produces no toner contamination and provides an "excellent" evaluation result.

The bias current applied to the secondary transfer roller 38 in Example 11 is set to −60 μA and has the opposite polarity to the positively-charged toner. The bias current applied to the pre-brush 39 is set to +5 μA and has the same polarity as the positively-charged toner. Controlling the bias values as such produces no toner contamination and provides an "excellent" evaluation result.

The bias current applied to the secondary transfer roller 38 in Example 12 is set to −40 μA and has the opposite polarity to the positively-charged toner. The bias current applied to the pre-brush 39 is set to +10 μA and has the same polarity as the positively-charged toner. Controlling the bias values as such produces no toner contamination and provides an "excellent" evaluation result. The application of the bias in Examples 9 to 12 is controlled as indicated by the lines 56*c*, 56*d*, and 56*e* in FIG. 10.

The bias current applied to the secondary transfer roller 38 in Comparative Example 7 is set to +40 μA and has the same polarity as the positively-charged toner. However, a bias is not applied to the pre-brush 39. Controlling the bias values as such produces toner contamination and provides a "poor" evaluation result.

The bias current applied to the secondary transfer roller 38 in Comparative Example 8 is set to −40 μA and has the opposite polarity to the positively-charged toner. However, a bias is not applied to the pre-brush 39 as with the case of Comparative Example 7. Controlling the bias values as such also produces toner contamination and provides a "poor" evaluation result.

The bias current applied to the secondary transfer roller 38 in Comparative Example 9 is set to +40 μA and has the same polarity as the positively-charged toner. The bias current applied to the pre-brush 39 is set to +5 μA and has the same polarity as the positively-charged toner. Controlling the bias values as such also produces toner contamination and provides a "poor" evaluation result.

Next, a description will be made about values of bias current applied to the pre-brush 39. The description also includes removal of retransferred toner. The following are the conditions of the experiment. The digital multifunction peripheral 11*b* used in this experiment has already formed a certain number of images on paper. The value of the bias current applied to the secondary transfer roller 38 during second transfer of images to paper was set to −40 μA. Under these conditions, patch images 53*a* to 53*d* and 54*a* to 54*d* in a single color, yellow, magenta, cyan, or black, were transferred onto [[a]] the transfer belt 35. From time T11 to time T18, as shown in FIG. 10, the patch images on the transfer belt 35 were carried to pass through the position 45*a* where the secondary transfer roller 38 was placed, in a no-paper state, that is, without feeding paper, and a bias was applied to the secondary transfer roller 38, pre-brush 39, and collecting roller 62. In this experiment, all values of bias current applied to the secondary transfer roller 38 at time T14 to retransfer the toner to the transfer belt 35 were set to +20 μA. After this process, paper was fed to check if the paper was soiled. The evaluation results are shown in Table 5.

TABLE 5

| | VALUES OF BIAS CURRENT APPLIED TO PRE-BRUSH | TONER CONTAM-INATION |
|---|---|---|
| EXAMPLE 13 | +10 μA | EXCELLENT |
| EXAMPLE 14 | +5 μA | EXCELLENT |

TABLE 5-continued

| | VALUES OF BIAS CURRENT APPLIED TO PRE-BRUSH | TONER CONTAM-INATION |
|---|---|---|
| EXAMPLE 15 | +15 μA | GOOD |
| COMPARATIVE EXAMPLE 10 | 0 | POOR |

Referring to Table 5, the bias current applied to the secondary transfer roller 38 in Example 13 is set to +10 μA and has the same polarity as the positively-charged toner. Controlling the bias value as such produces no toner contamination and provides an "excellent" evaluation result.

The bias current applied to the pre-brush 39 in Example 14 is set to +5 μA and has the same polarity as the positively-charged toner. Controlling the bias value as such produces no toner contamination and provides an "excellent" evaluation result.

The bias current applied to the pre-brush 39 in Example 15 is set to +15 μA and has the same polarity as the positively-charged toner. Controlling the bias value as such produces no toner contamination and provides a "good" evaluation result.

On the other hand, if the pre-brush 39 is not biased as shown in Comparative Example 10, toner contamination occurs and provides a "poor" evaluation result.

Next, a description will be made about values of bias current applied to the secondary transfer roller 38. The following are the conditions of the experiment. The digital multifunction peripheral 11*b* used in this experiment has already formed a certain number of images on paper. Under these conditions, patch images 53*a* to 53*d* and 54*a* to 54*d* in a single color, yellow, magenta, cyan, or black, were transferred onto the transfer belt 35. From time T11 to time T18, as shown in FIG. 10, a bias was applied to the secondary transfer roller 38, pre-brush 39, and collecting roller 62. In this experiment, the values of the bias current applied to the secondary transfer roller 38 at time T14 to retransfer the toner onto the transfer belt 35 were set to +20 μA. Then, the patch images on the transfer belt 35 were carried to pass through the position 45*a* where the secondary transfer roller 38 was placed, in a no-paper state, that is, without feeding paper. After this process, paper was fed to check if the paper was soiled. The evaluation results are shown in Table 6.

TABLE 6

| | VALUES OF BIAS CURRENT APPLIED TO SECONDARY TRANSFER ROLLER | NUMBER OF ROTATIONS REQUIRED TO REMOVE TONER CONTAM-INATION |
|---|---|---|
| EXAMPLE 16 | −20 μA | 5 |
| EXAMPLE 17 | −30 μA | 3 |
| EXAMPLE 18 | −40 μA | 3 |
| EXAMPLE 19 | −50 μA | 3 |
| EXAMPLE 20 | −60 μA | 3 |

Referring to Table 6, the value of bias current applied to the secondary transfer roller 38 at time T11 is set to −20 μA in Example 16, −30 μA in Example 17, −40 μA in Example 18, −50 μA in Example 19, and −60 μA in Example 20. Table 6 also indicates the number of rotations of the secondary transfer roller 38.

The secondary transfer roller 38 in Example 16 rotates five times, but rotates three times in Examples 17 to 20. The number of rotations is preferable to be as few as possible. The fewer the number of rotations is, the sooner the toner contamination can be removed. Therefore, a preferable value of bias current to be applied to the secondary transfer roller 38 is −40 μA or lower so as to reliably remove contamination within a few rotations, which is three times. The current value of −40 μA is also used to transfer toner onto paper. Specifically, the control unit 12*a* serves as the first control unit to control the absolute value of the bias applied by the second bias applicator 44*b* to be equal or higher than the absolute value of the bias applied during secondary transfer in which the toner is transferred onto paper as a recording medium.

Although a foam rubber roller is used as the secondary transfer roller in this embodiment, the present disclosure is not limited thereto, and can use other types of secondary transfer roller. In addition, an electrically conductive acrylic is used as the collecting roller; however, the present disclosure is not limited thereto, and can use other types of collecting roller. A layered-type transfer belt is used as the transfer belt; however, the present disclosure is not limited thereto, and can use a single-layered-type transfer belt.

In the above-described embodiment, the control unit 12*a* can be configured so as to serve as the first and second control units when the absolute moisture content is 1.4 g/m3 or lower. The amount of charge of toner naturally increases in such an environment, and therefore the electric adhesion of the toner to the transfer belt 35 is relatively enhanced. This is the reason to actuate the first and second control units in the environment.

In the above-described embodiments, the digital multifunction peripherals 11*a*, 11*b* can be built without the thermo-hygrometer for measuring temperature and humidity. In other words, the digital multifunction peripherals 11*a*, 11*b* can dispense with the absolute moisture measuring unit. In this case, the digital multifunction peripherals 11*a*, 11*b* acquire data about absolute moisture content externally transmitted via the network.

Although a foam rubber roller is used as the secondary transfer roller in these embodiments, the present disclosure is not limited thereto, and can use other types of secondary transfer roller.

In the above-describe embodiments, the bias to be applied is defined as current values; however, the present disclosure is not limited thereto, and can use bias defined as corresponding voltage values.

Although the positively-charged toner is used in the above-described embodiments, the present disclosure is not limited thereto, and can use negatively-charged toner. When using the negatively-charged toner, the bias to be applied has the opposite polarities.

In the above-described embodiments, a transfer belt is employed as a transfer member; however, the present disclosure is not limited thereto, and can use other types of transfer member.

The above-described embodiments have been provided to describe removal of toner that forms patch images from a transfer belt 35, the patch images being primarily transferred onto the transfer belt 35; however, the present disclosure is not limited thereto, and can be applied to, for example, removal of toner from the transfer belt 35 when, after an image formed with the toner is primarily transferred onto the transfer belt 35, the multifunction peripheral stops its operation due to a paper jam.

Figure 11:
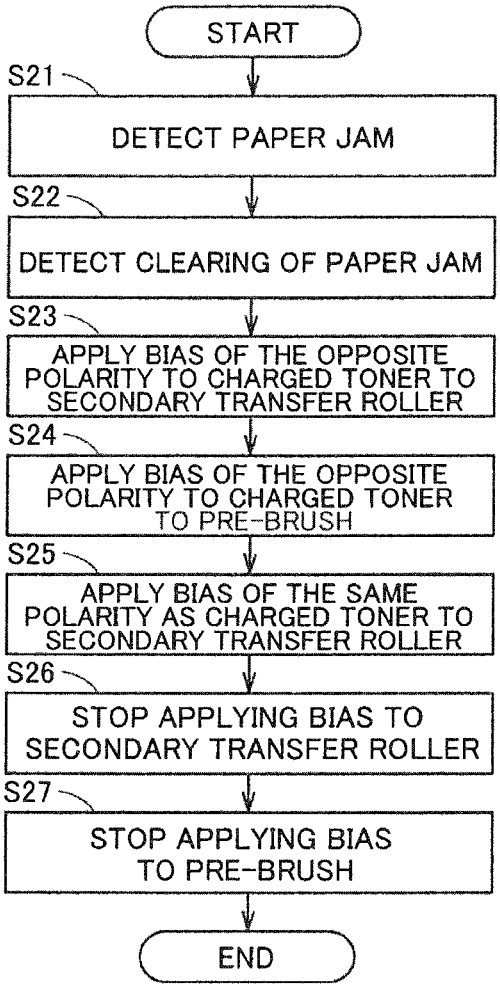
FIG. 11 is a flow chart describing an operational procedure to remove toner remaining on a surface of a transfer belt after a paper jam occurs.

FIG. 11 is a flow chart describing an operational procedure to remove residual toner on the surface 42 of the transfer belt 35 after a paper jam occurs. The flow chart shown in FIG. 11 corresponds to the flow chart shown in FIG. 6.

Referring to FIG. 11, after a digital multifunction peripheral 11*a* (11*b*) receives a request to print an image on paper, photoreceptors 31*a* to 31*d* and developing units 32*a* to 32*d* form toner images of the image, respectively. The formed toner images are primarily transferred by primary transfer rollers 36*a* to 36*d* onto the surface 42 of the transfer belt 35.

After the primary transfer, the digital multifunction peripheral 11*a* (11*b*) detects that paper to be fed through the paper transport path 43*a* has failed to be fed at a predetermined timing due to a paper jam. In short, a paper jam is detected (S21).

The digital multifunction peripheral 11*a* (11*b*) ceases operating and displays a message on the display screen 21 that prompts a user to clear the paper jam. Then, the digital multifunction peripheral 11*a* (11*b*) detects that the user has cleared the paper jam (S22).

Subsequently, the digital multifunction peripheral 11*a* (11*b*) resumes operation. In this case, the request to print the image on paper is processed again. Because the toner images have been already primarily transferred onto the surface 42 of the transfer belt 35, the toner forming the toner images is removed. Specifically, the same processes in S13 to S17 are performed in S23 to S27. In the same manner as performed on the above-described patch images, the toner images primarily transferred onto the transfer belt 35 are removed. The digital multifunction peripheral 11*a* (11*b*) configured as above is acceptable.

It should be understood that the embodiments and examples disclosed herein are illustrative and non-restrictive in every respect. The scope of the present disclosure is defined by the terms of the claims, rather than by the foregoing description, and is intended to include any modifications within the scope and meaning equivalent to the terms of the claims.

The image forming apparatus according to the present disclosure can be effectively used especially to meet a demand for simple configuration to efficiently remove residual toner on an intermediate transfer member.

What is claimed is:

1. An image forming apparatus comprising:

a photoreceptor;

a developing unit that forms a toner image on the photoreceptor;

an intermediate transfer member that rotates in only one direction and has a surface onto which the toner image formed on the photoreceptor is primarily transferred;

a primary transfer roller that primarily transfers the toner image formed on the photoreceptor onto the intermediate transfer member with application of a bias;

a first bias applicator that applies a bias to the primary transfer roller;

a secondary transfer roller that secondarily transfers the toner image primarily transferred on the intermediate transfer member onto a recording medium with application of a bias;

a second bias applicator that applies a bias to the secondary transfer roller;

a pre-brush that is placed downstream of the secondary transfer roller along a rotational direction of the intermediate transfer member, and abuts against the surface of the intermediate transfer member;

a pre-brush bias applicator that applies a bias to the pre-brush;

a cleaning blade that is placed downstream of the pre-brush along the rotational direction of the intermediate transfer member, and abuts against the surface of the intermediate transfer member to remove toner remaining on the intermediate transfer member;

a first control unit that, when the toner passes through a position where the secondary transfer roller is placed, controls the second bias applicator to apply to the secondary transfer roller a bias of the opposite polarity to that of a charge of the toner to remove the toner, which is primarily transferred onto the intermediate transfer member, from the intermediate transfer member; and a second control unit that, after the operation of the first control unit, controls the second bias applicator to apply to the secondary transfer roller a bias of the same polarity as that of the charged toner and then controls the pre-brush bias applicator to apply to the pre-brush a bias of the opposite polarity to that of the toner.

2. The image forming apparatus according to claim 1, wherein when the toner passes through the position where the secondary transfer roller is placed, the first control unit controls the pre-brush bias applicator to apply to the pre-brush a bias of the opposite polarity to that of the toner.

3. The image forming apparatus according to claim 1, wherein the first control unit controls an absolute value of the bias applied by the second bias applicator to be equal or lower than an absolute value of the bias applied during secondary transfer in which the toner is transferred onto the recording medium.

4. The image forming apparatus according to claim 1, wherein the second control unit controls the bias applied by the pre-brush bias applicator to be a current value of 40 μA or higher expressed in absolute value.

5. The image forming apparatus according to claim 1, further comprising an absolute moisture content measuring unit that measures an absolute moisture content of an environment where the image forming apparatus is installed, wherein the first and second control units are activated when the absolute moisture content, measured by the absolute moisture content measuring unit, of the environment where the image forming apparatus is installed is 1.4 g/m3 or lower.

6. An image forming apparatus comprising:

a photoreceptor;

a developing unit that forms a toner image on the photoreceptor;

an intermediate transfer member that rotates in only one direction and has a surface onto which the toner image formed on the photoreceptor is primarily transferred;

a primary transfer roller that primarily transfers the toner image formed on the photoreceptor onto the intermediate transfer member with application of a bias;

a first bias applicator that applies a bias to the primary transfer roller;

a secondary transfer roller that secondarily transfers the toner image primarily transferred on the intermediate transfer member onto a recording medium with application of a bias;

a second bias applicator that applies a bias to the secondary transfer roller;

a pre-brush that is placed downstream of the secondary transfer roller along the rotational direction of the intermediate transfer member, and abuts against the surface of the intermediate transfer member;

a pre-brush bias applicator that applies a bias to the pre-brush;

a cleaning brush that is placed downstream of the pre-brush along the rotational direction of the intermediate transfer member, and abuts against the surface of the intermediate transfer member to remove toner remaining on the intermediate transfer member;

a collecting roller that is placed so as to abut against the cleaning brush and collects toner clinging to the cleaning brush;

a collecting-roller bias applicator that applies a bias to the collecting roller;

a cleaning blade that abuts against a surface of the collecting roller and removes toner clinging to the collecting roller;

a first control unit that, when the toner passes through a position where the secondary transfer roller is placed, controls the second bias applicator to apply to the secondary transfer roller a bias of the opposite polarity to that of a charge of the toner and controls the pre-brush bias applicator to apply to the pre-brush a bias having the same polarity as that of the toner and an absolute value smaller than that of the bias applied by the second bias applicator to remove the toner, which is primarily transferred onto the intermediate transfer member, from the intermediate transfer member; and a second control unit that, after the operation of the third control unit, controls the second bias applicator to apply to the secondary transfer roller a bias of the same polarity as that of the charged toner.

7. The image forming apparatus according to claim 6, wherein the second control unit controls the pre-brush bias applicator to stop applying to the pre-brush a bias of the same polarity as that of the toner after the lapse of a time period required for the toner, which has passed through the position where the secondary transfer roller is placed, to travel from the position where the secondary transfer roller is placed to a position where the pre-brush is placed.

8. The image forming apparatus according to claim 6, wherein the first control unit controls an absolute value of the bias applied by the second bias applicator to be equal or lower than an absolute value of the bias applied during secondary transfer in which the toner is transferred onto the recording medium.

9. The image forming apparatus according to claim 6, wherein the second control unit controls the bias applied by the pre-brush bias applicator to be a current value of higher than 0 μA but lower than 15 μA expressed in absolute value.

10. The image forming apparatus according to claim 6, further comprising an absolute moisture content measuring unit that measures an absolute moisture content of an environment where the image forming apparatus is installed, wherein the first and second control units are activated when the absolute moisture content, measured by the absolute moisture content measuring unit, of the environment where the image forming apparatus is installed is 1.4 g/m3 or lower.

* * * * *